US012313380B2

(12) United States Patent
LeMarbe

(10) Patent No.: US 12,313,380 B2
(45) Date of Patent: May 27, 2025

(54) PROTECTIVE MANTEL AND ACCESSORY HUB

(71) Applicant: Point Blank Enterprises, Inc., Pompano Beach, FL (US)

(72) Inventor: Randall Jered LeMarbe, Pompano Beach, FL (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 43 days.

(21) Appl. No.: 17/737,202

(22) Filed: May 5, 2022

(65) Prior Publication Data

US 2023/0012612 A1 Jan. 19, 2023

Related U.S. Application Data

(60) Provisional application No. 63/184,603, filed on May 5, 2021.

(51) Int. Cl.

| | |
|---|---|
| ***A41H 1/02*** | (2006.01) |
| ***A41D 13/00*** | (2006.01) |
| ***F41H 1/02*** | (2006.01) |

(52) U.S. Cl.
CPC ..... *F41H 1/02* (2013.01); *A41D 13/0005* (2013.01)

(58) Field of Classification Search
CPC ..... F41H 1/02; A41D 13/0005
See application file for complete search history.

(56) References Cited

U.S. PATENT DOCUMENTS

| | | | | |
|---|---|---|---|---|
| 3,981,027 | A * | 9/1976 | Anderson | A63B 71/12 2/462 |
| 5,060,314 | A * | 10/1991 | Lewis | A62B 17/003 2/2.5 |
| 6,029,270 | A | 2/2000 | Ost et al. | |
| 9,144,255 | B1 * | 9/2015 | Perciballi | A41D 27/00 |
| 10,274,289 | B1 * | 4/2019 | Barnhart, II | F41H 1/02 |

(Continued)

FOREIGN PATENT DOCUMENTS

| | | |
|---|---|---|
| CN | 202364817 U | 8/2012 |
| DE | 20214008697 U1 | 12/2014 |

(Continued)

OTHER PUBLICATIONS

Shift 360™ scalable plate rack system; https://safariland.com/products/shift-360-scalable-plate-rack-system-shift_360; Apr. 11, 2022.

(Continued)

*Primary Examiner* — Khaled Annis
(74) *Attorney, Agent, or Firm* — Geoffrey Lottenberg; Berger Singerman LLP

(57) ABSTRACT

A protective mantel and accessory hub includes a primary yoke configured to be worn underneath an armor carrier. Sliding attachment points removably connect the armor carrier to the upper protector to allow for mobility and articulation. Accessories such as a throat guard and deltoid guards are removably attached to the mantel. Shoulder suspension members are inserted into the primary yoke to support and distribute the weight of the armor carrier. The armor carrier includes a magnetically attachable front accessory panel and zippered pouches on the front and back to receive and retain body armor plates.

22 Claims, 43 Drawing Sheets

(56) References Cited

U.S. PATENT DOCUMENTS

| | | | | |
|---|---|---|---|---|
| 10,485,272 | B2 * | 11/2019 | Blauer | A41D 27/02 |
| 10,517,336 | B2 * | 12/2019 | Monica | A41D 13/015 |
| 10,582,731 | B2 * | 3/2020 | Williams | B32B 5/028 |
| 10,646,769 | B1 * | 5/2020 | Farris | A41D 13/0015 |
| 11,192,018 | B2 * | 12/2021 | Monica | A41D 13/015 |
| 11,272,751 | B2 * | 3/2022 | Popejoy | A42B 3/08 |
| 11,385,028 | B1 * | 7/2022 | LeMarbe | A41D 13/0005 |
| 2004/0205881 | A1 * | 10/2004 | Morrow | A41D 13/0518 2/459 |
| 2005/0086728 | A1 * | 4/2005 | Tobergte | A63B 71/12 2/459 |
| 2005/0166303 | A1 * | 8/2005 | Aaron | A63B 71/10 2/2.5 |
| 2006/0143771 | A1 * | 7/2006 | Winkle | F41H 1/02 2/69 |
| 2007/0028339 | A1 * | 2/2007 | Carlson | F41H 1/02 2/2.5 |
| 2008/0134419 | A1 * | 6/2008 | Kalaam | F41H 1/02 2/2.5 |
| 2008/0313793 | A1 * | 12/2008 | Skottheim | A41D 13/015 2/463 |
| 2009/0211000 | A1 * | 8/2009 | Roux | F41H 1/02 2/2.5 |
| 2011/0004968 | A1 * | 1/2011 | Morgan | B63C 9/135 2/2.5 |
| 2012/0174273 | A1 * | 7/2012 | Frost | F41H 1/02 2/2.5 |
| 2014/0196203 | A1 * | 7/2014 | Cole | F41H 1/02 24/305 |
| 2015/0247705 | A1 * | 9/2015 | Martinez | A41D 13/0153 2/2.5 |
| 2015/0282536 | A1 * | 10/2015 | Kumuchian | A41D 13/0525 2/463 |
| 2015/0369567 | A1 * | 12/2015 | Hall | F41H 1/02 89/36.05 |
| 2016/0187103 | A1 * | 6/2016 | Coats | G01N 3/313 2/2.5 |
| 2016/0238347 | A1 * | 8/2016 | Blauer | A41D 3/005 |
| 2017/0082404 | A1 * | 3/2017 | Blauer | F41H 1/02 |
| 2017/0307335 | A1 * | 10/2017 | Skifstad | F41C 33/041 |
| 2018/0058818 | A1 * | 3/2018 | Beck | F41H 1/02 |
| 2018/0180387 | A1 * | 6/2018 | Caballero | F41H 1/02 |
| 2018/0321017 | A1 | 11/2018 | Jonassen et al. | |
| 2019/0323800 | A1 | 10/2019 | Bohringer et al. | |
| 2023/0079499 | A1 * | 3/2023 | Postolek | A44B 18/0073 2/270 |
| 2023/0160668 | A1 * | 5/2023 | Groat | F41H 5/0485 89/36.05 |

FOREIGN PATENT DOCUMENTS

| | | | | |
|---|---|---|---|---|
| FR | 2483353 | | 12/1981 | |
| GB | 2315984 | A * | 2/1998 | A41D 13/00 |
| GB | 2518669 | A | 4/2015 | |
| JP | 2010255152 | | 11/2010 | |
| KR | 101615176 | | 4/2016 | |
| WO | 96/24816 | | 8/1996 | |
| WO | WO-2007146810 | A2 * | 12/2007 | A41D 13/0002 |
| WO | 2012/113857 | A1 | 8/2012 | |
| WO | WO-2012113875 | A1 * | 8/2012 | F41H 1/02 |
| WO | WO-2017086800 | A1 * | 5/2017 | F41H 1/02 |

OTHER PUBLICATIONS

Tactical bulletproof vest—guardian; https://www.hardshell.ae/wpcproduct/tactical-vest-guardian/; Apr. 11, 2022.

Additional removable Ballistic Cloth protection around the shoulders, throat and groin areas; https://contest.techbriefs.com/2017/entries/aerospace-and-defense/7851; Apr. 11, 2022.

* cited by examiner

PROTECTIVE MANTEL AND ACCESSORY HUB

CROSS REFERENCE TO RELATED APPLICATIONS

This application claims the benefit of U.S. Provisional Application No. 63/184,603 filed on May 5, 2021.

Figure 1:
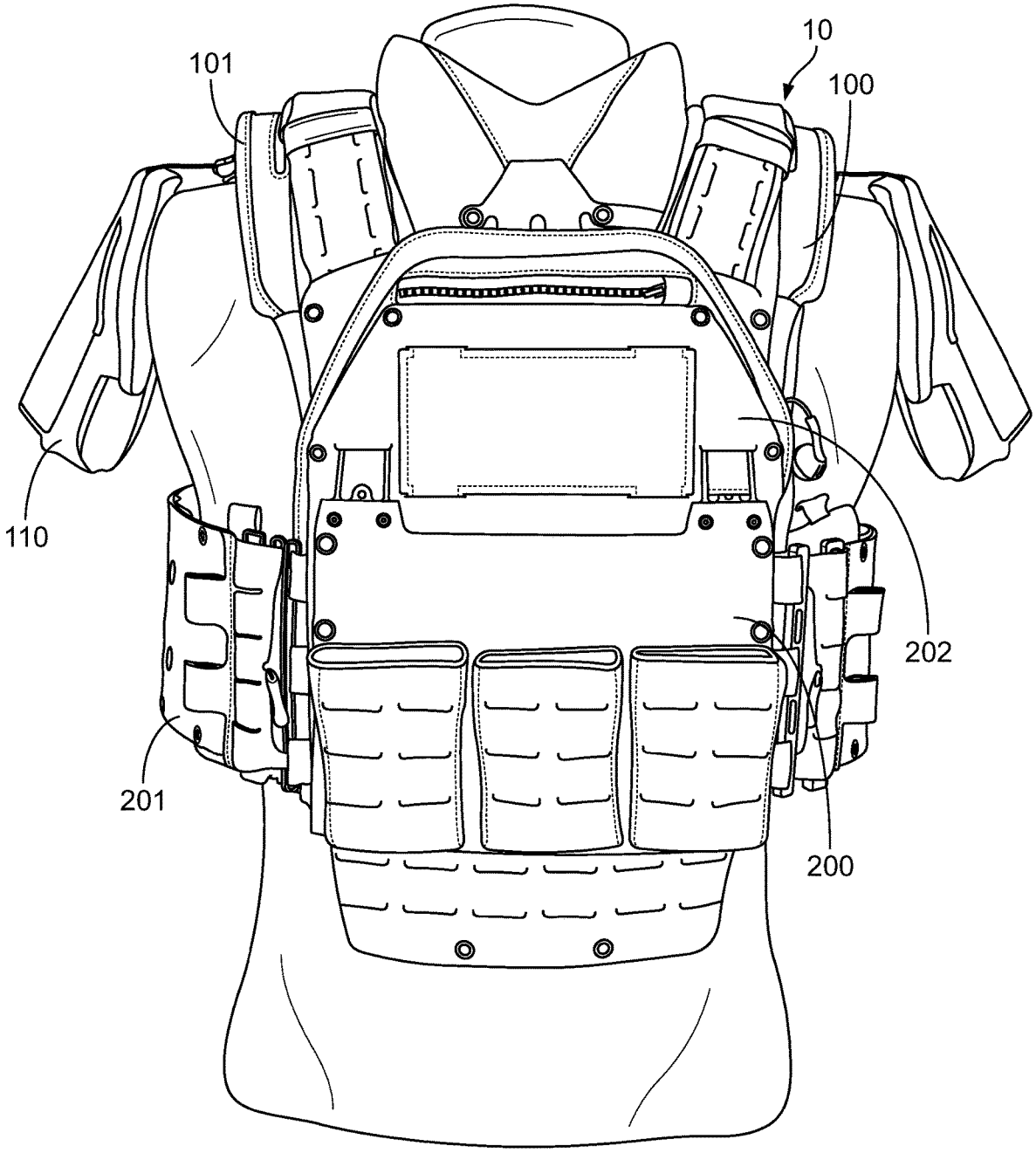
FIG. 1 is a front view of the body armor system.
Figure 2:
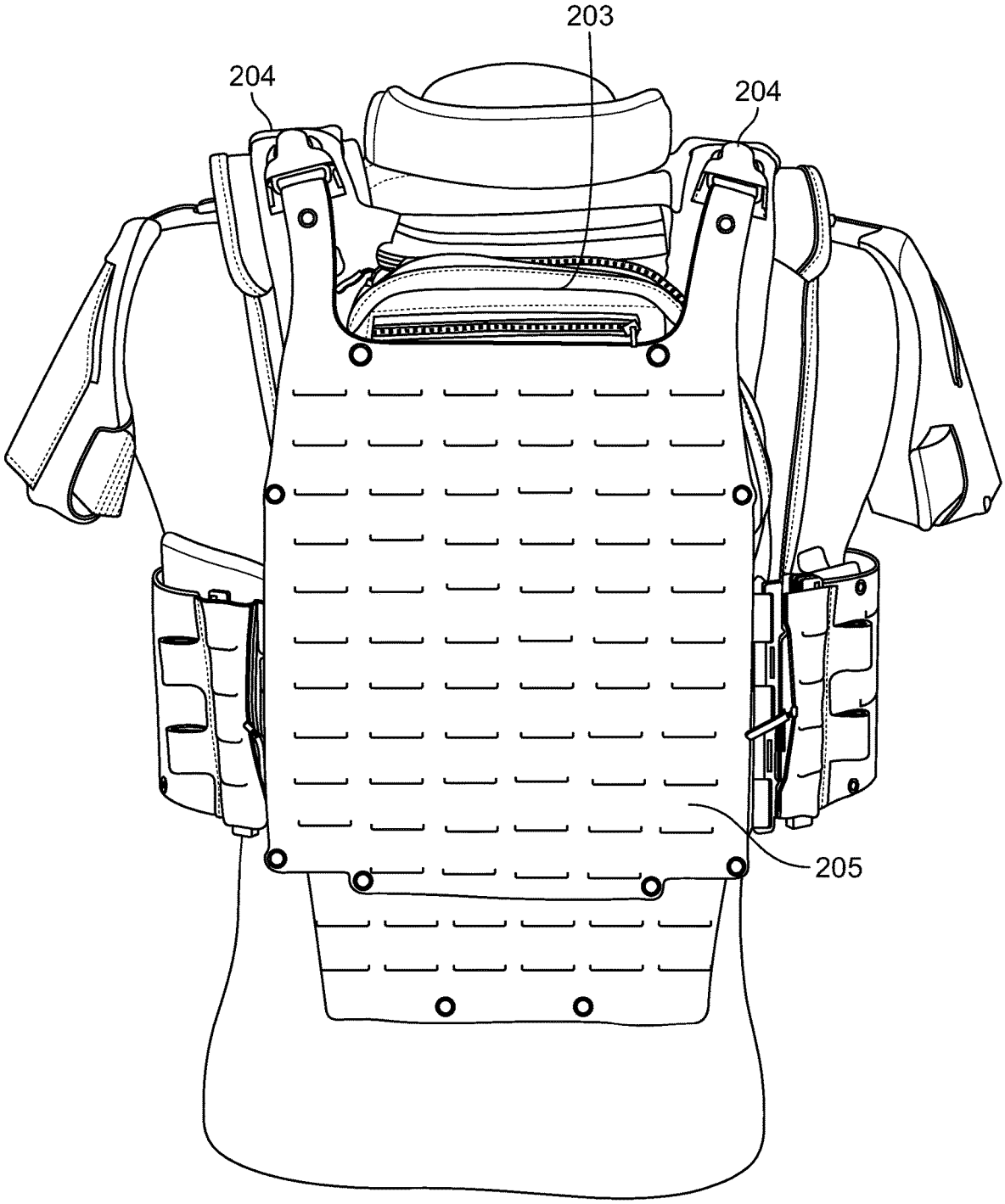
FIG. 2 is a rear view of the body armor system.
Figure 3:
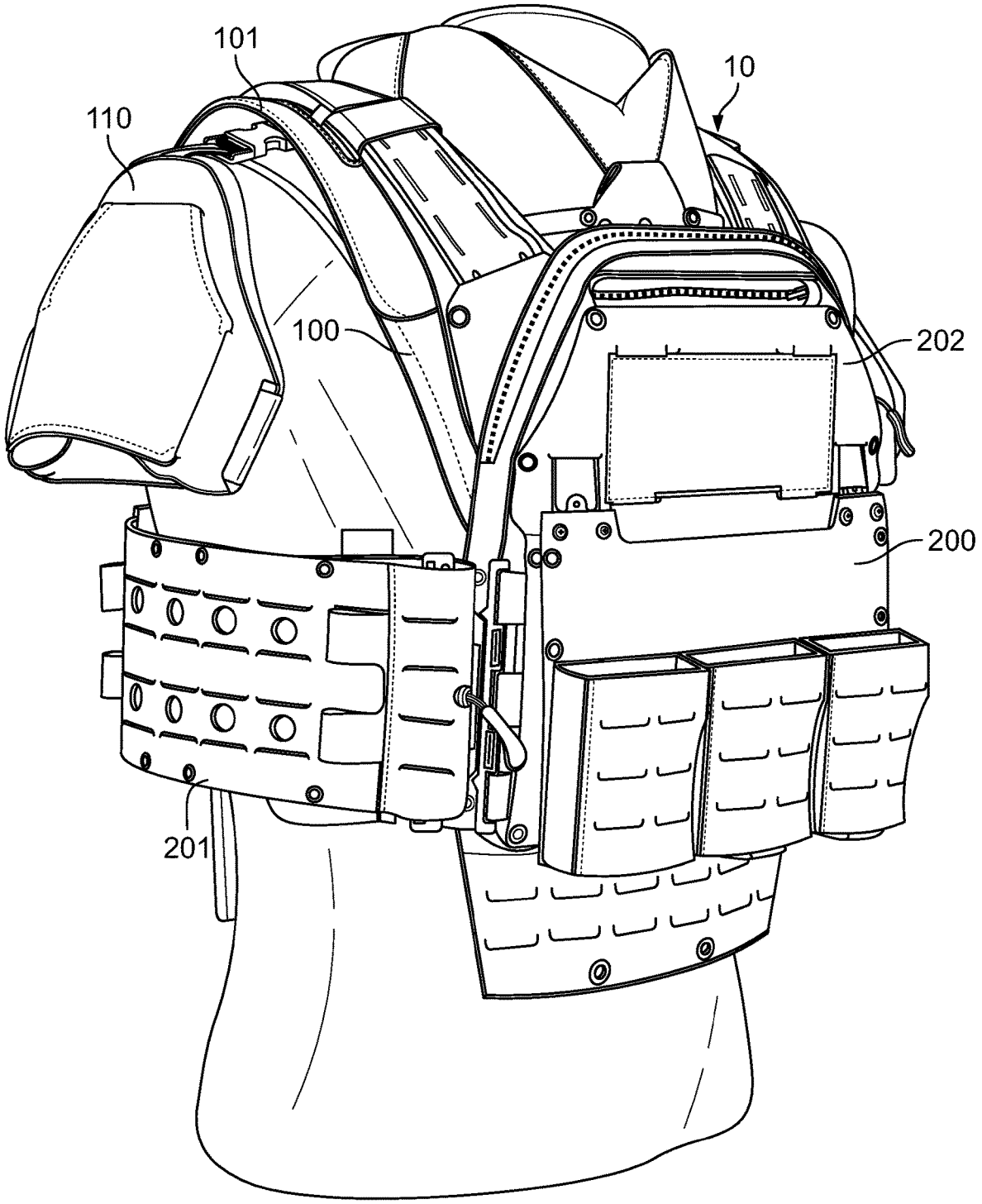
FIG. 3 is a front isometric view of the body armor system.
Figure 4:
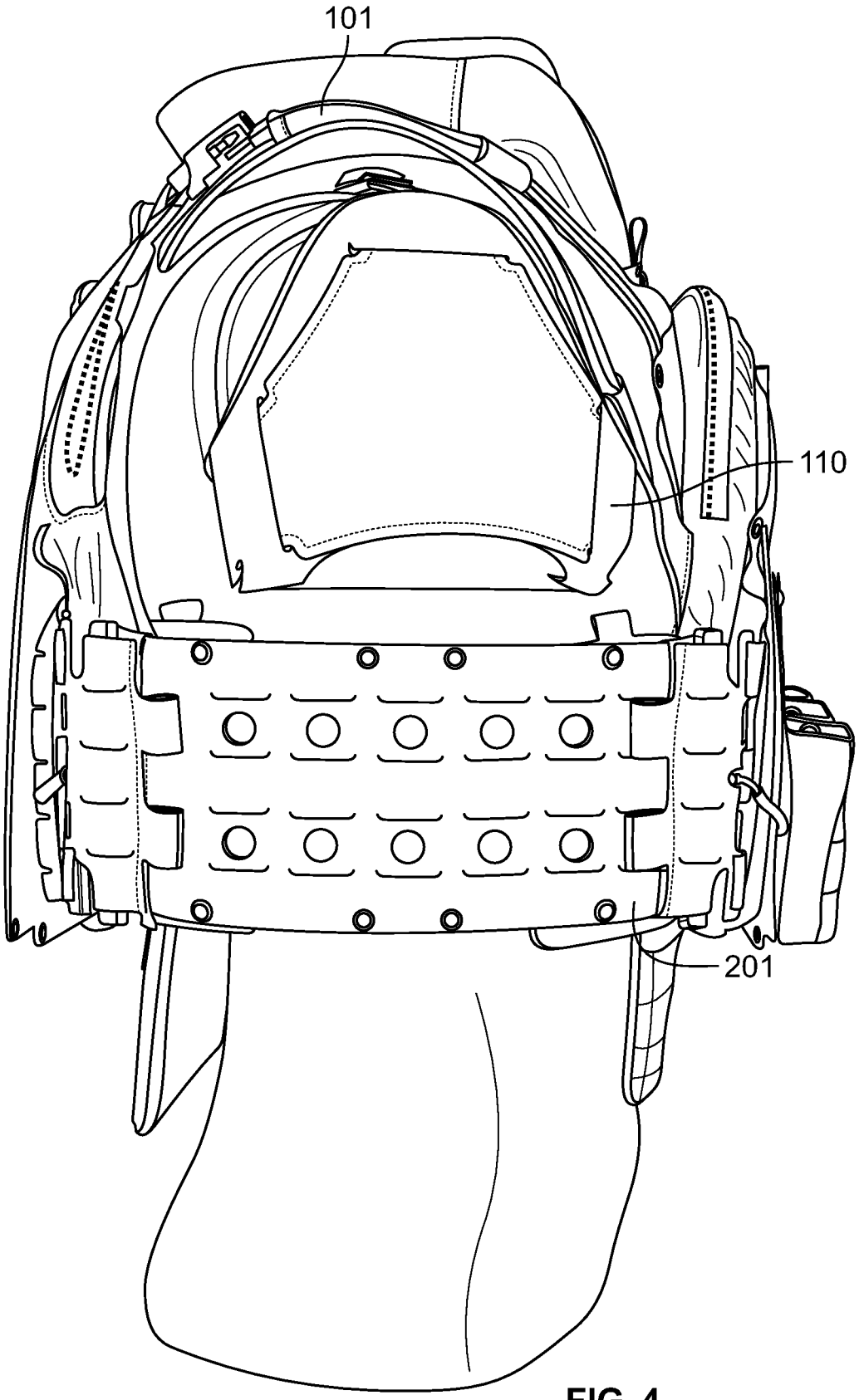
FIG. 4 is a right side view of the body armor system.
Figure 5:
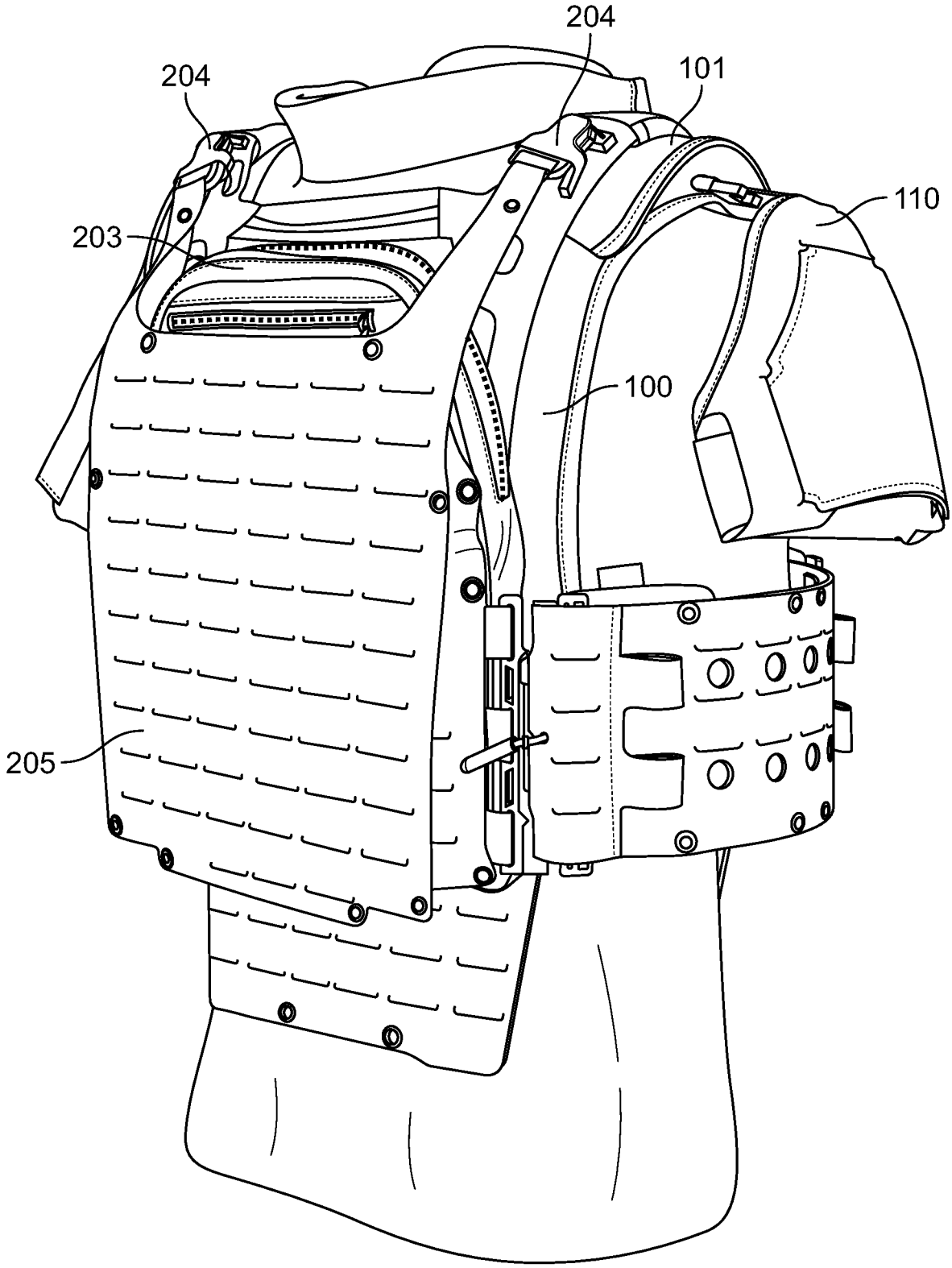
FIG. 5 is a rear isometric view of the body armor system.
Figure 6:
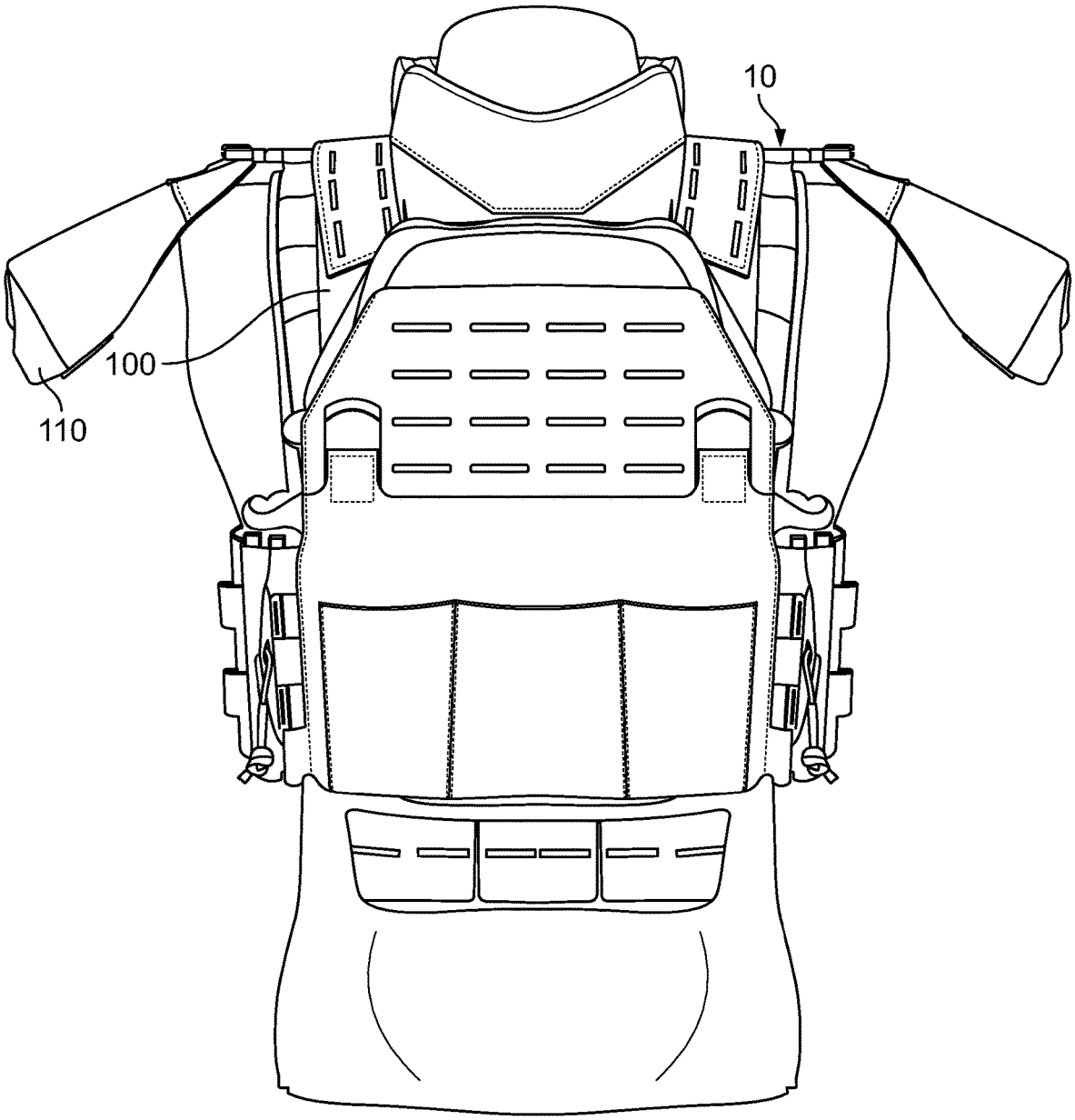
FIG. 6 is a front view of the body armor system without the shoulder suspension members.
Figure 7:
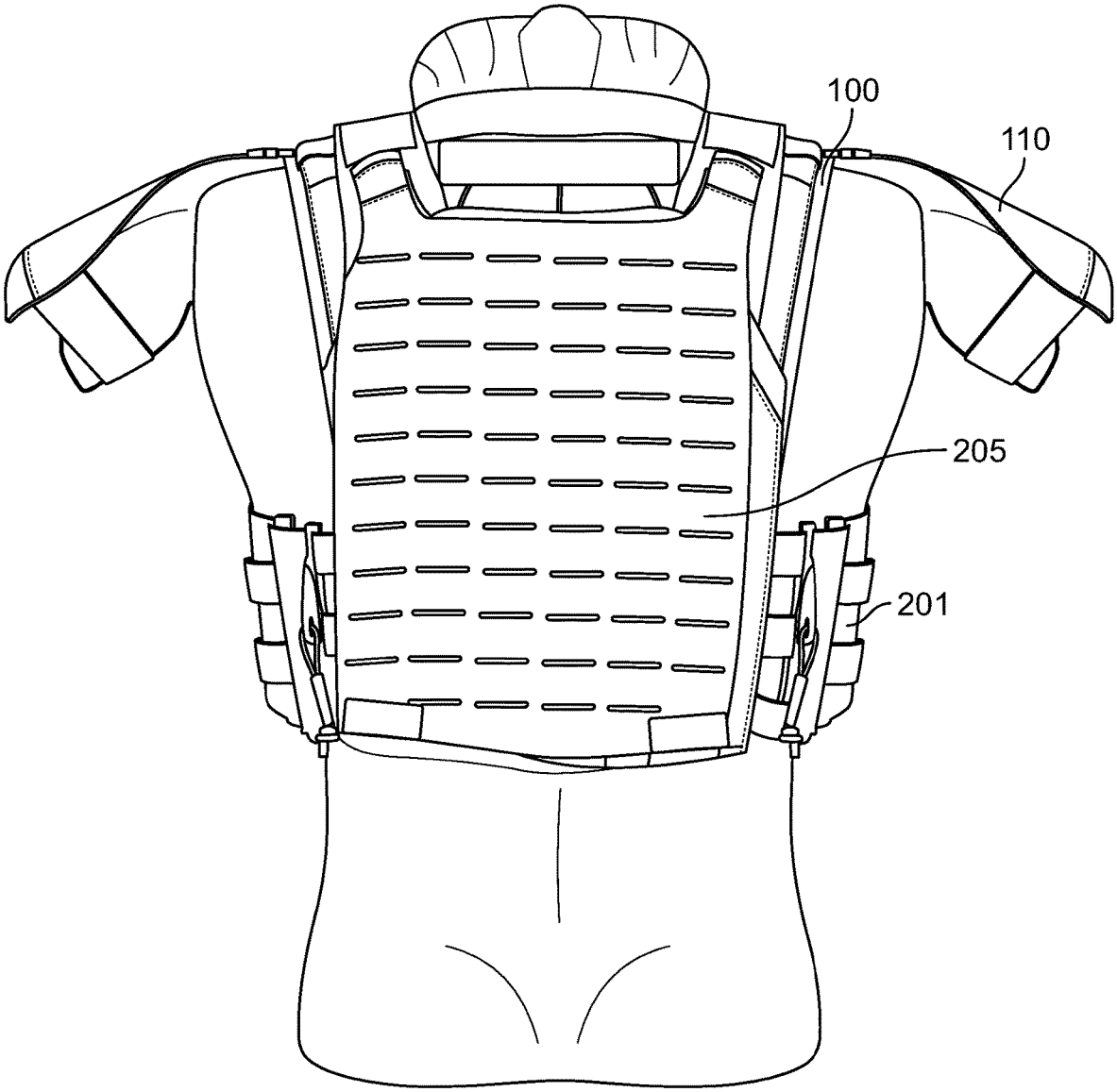
FIG. 7 is a rear view of the body armor system without the shoulder suspension members.
Figure 8:
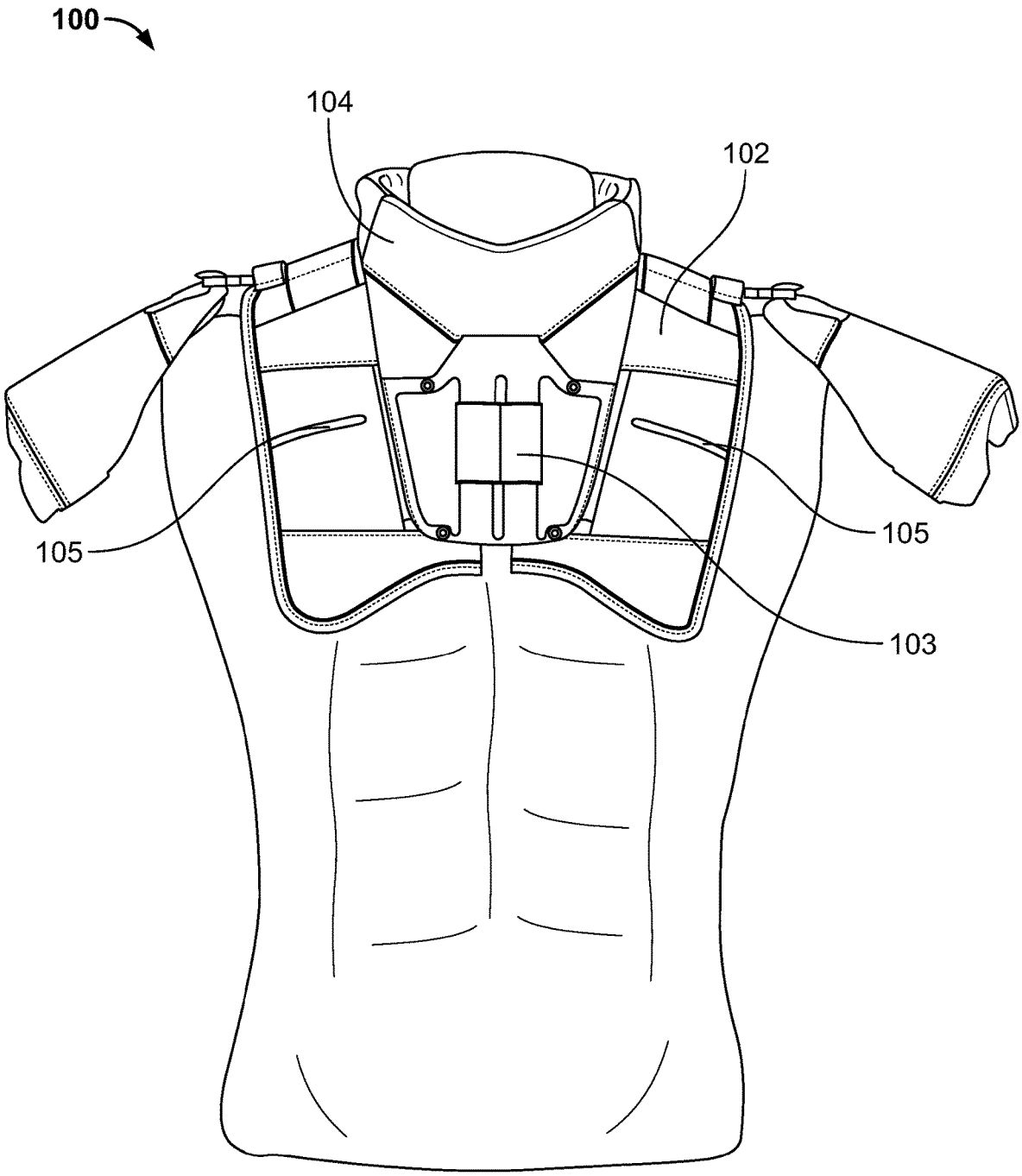
FIG. 8 is a front view of the upper protector.
Figure 9:
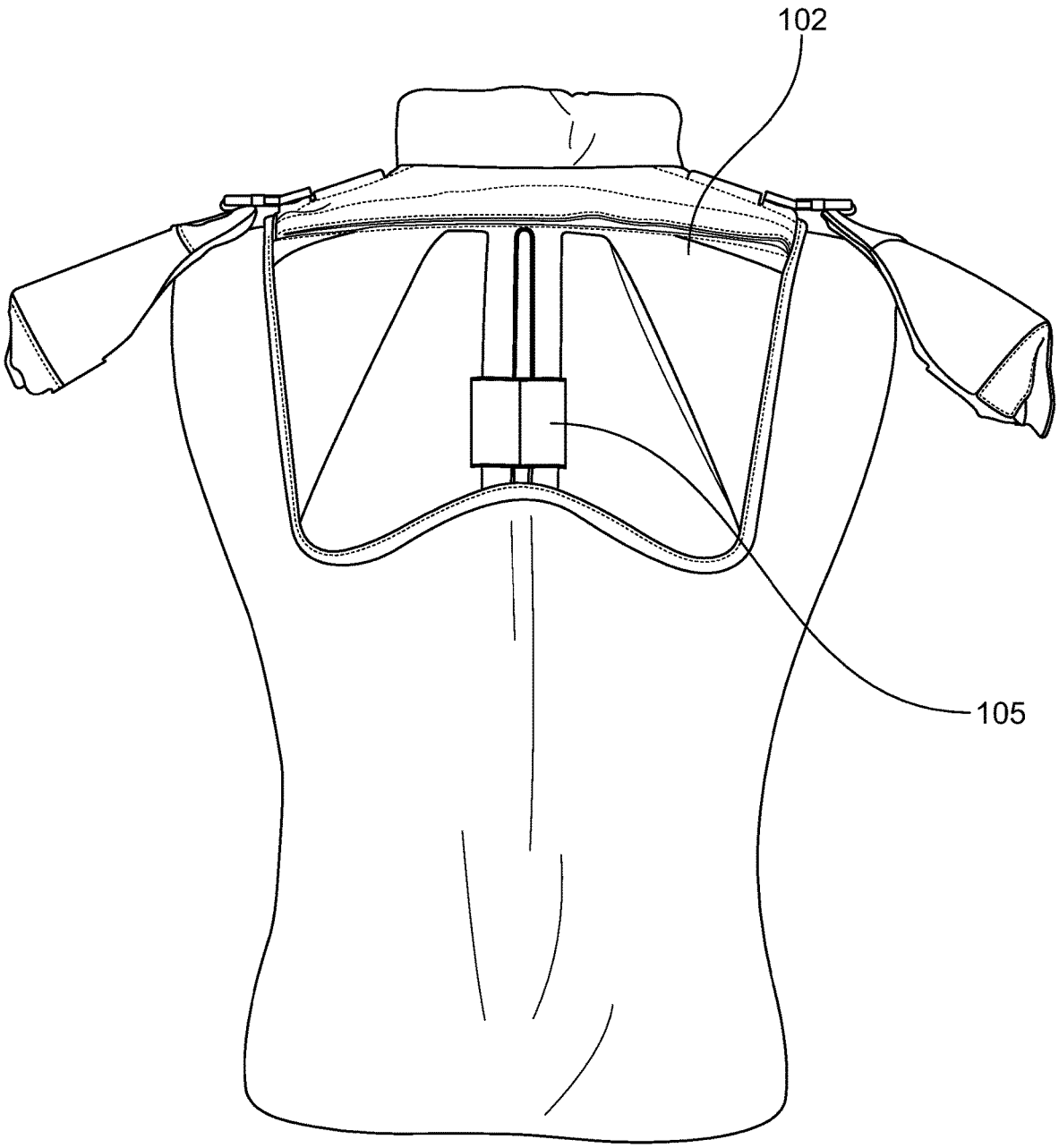
FIG. 9 is a rear view of the upper protector.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE INVENTION

In the following description, for the purposes of explanation, numerous specific details are set forth in order to provide a thorough understanding of the present invention. It will be apparent, however, to one skilled in the art that invention may be practiced without some of these specific details. Throughout this description, the embodiments and examples shown should be considered as exemplars, rather than as limitations on the invention. That is, the following description provides examples, and the accompanying drawings show various examples for the purposes of illustration. However, these examples should not be construed in a limiting sense as they are merely intended to provide examples of the invention rather than to provide an exhaustive list of all possible implementations of the invention.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

Body Armor System

With reference to FIGS. 1-7 shown is an embodiment a body armor system comprising an armor carrier 200 disposed over an upper protector 100. The upper protector is also referred to herein as a mantel and/or accessory hub. The upper protector is disposed over the shoulders and provides protection for the upper shoulders and neck area of the wearer. The upper protector also provides structure to comfortably retain the weight of the carrier across the shoulders and upper body of the wearer. In some embodiments, the upper protector includes shoulder suspension members 101 inserted into openings on the anterior and posterior of the upper protector, about the shoulder area, which assist in supporting the weight of the armor carrier 200. In some embodiments, a deltoid guard 110 is attached to either or both sides of the upper protector. The armor carrier 200 is disposed over the upper protector 100, resting on the shoulders of the wearer and generally protects the thorax of the wearer. The system uses combinations of soft and hard armor to provide protection against blunt objects, sharp objects, ballistics, and fragmentation.

Upper Protector

Figure 20:
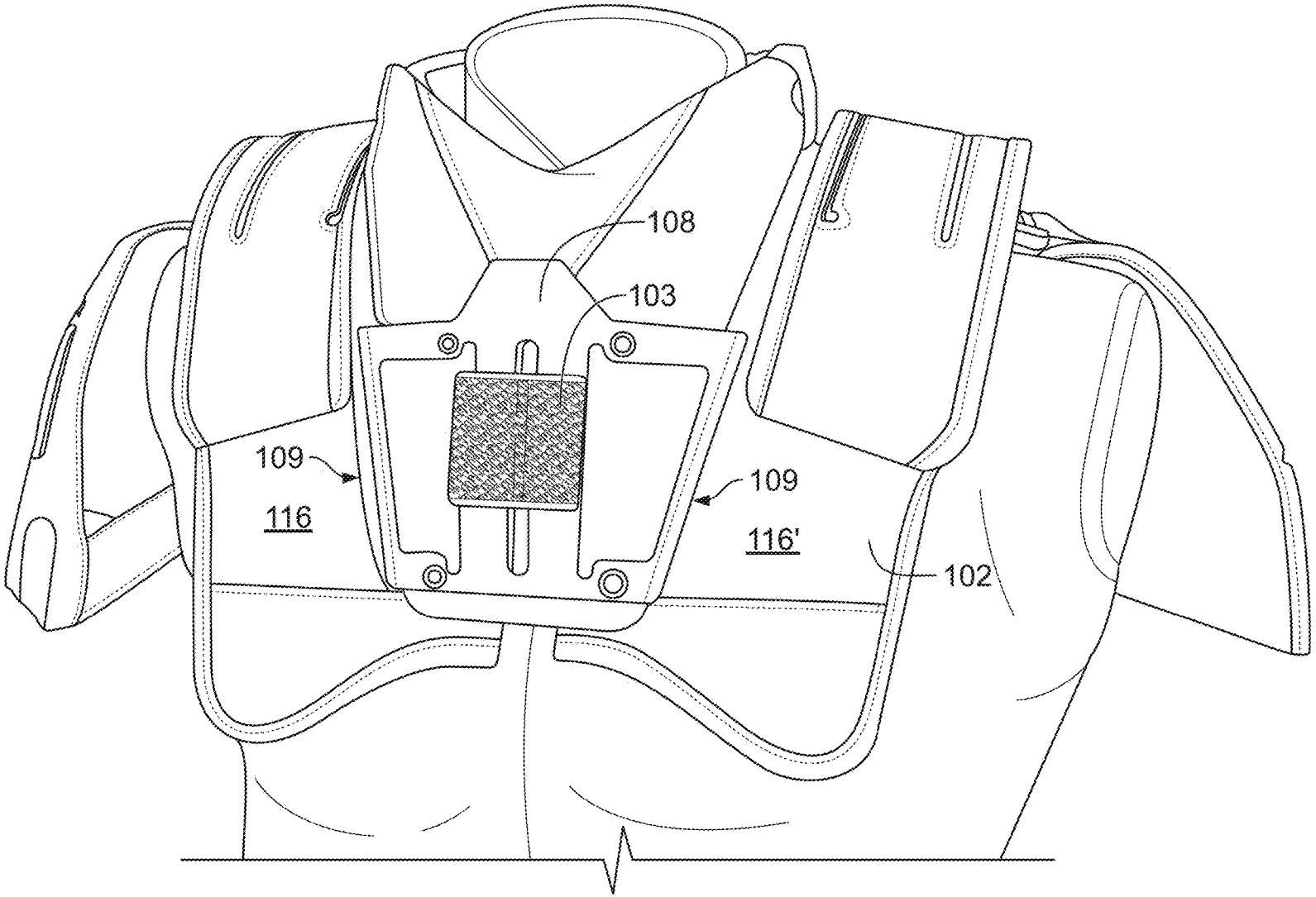
FIG. 20 shows a lateral expansion feature of the upper protector.

With reference to FIGS. 8-11, shown is an embodiment of the mantel 100 without the armor carrier 200. The mantel includes a primary yoke 102 which comprises the supporting structure of the protector that drapes at least partially over the thorax (upper back and upper chest) of the wearer. The yoke 102 retains a throat guard 104 which is inserted at its edges into corresponding openings on the yoke 102. At the center of either or both of the front and back of the yoke 102 is a sliding attachment point 103. For example, with reference to FIG. 20 shown is the sliding attachment point 103 disposed on the central panel 108 of the yoke 102. In some embodiments, the attachment point 103 comprises hook and loop fastener or another removable fastener such as a snap or buckle which engages a corresponding attachment point on the inside of the armor carrier 200. The attachment point 103 is configured to slide in a vertical direction along the upper protector 100 in order to allow the armor carrier 200 to articulate relative to the upper protector 100 to maximize comfort and mobility for the wearer. Also shown are openings 105 which receive the shoulder suspension member 101 as further shown and described herein.

Figure 10:
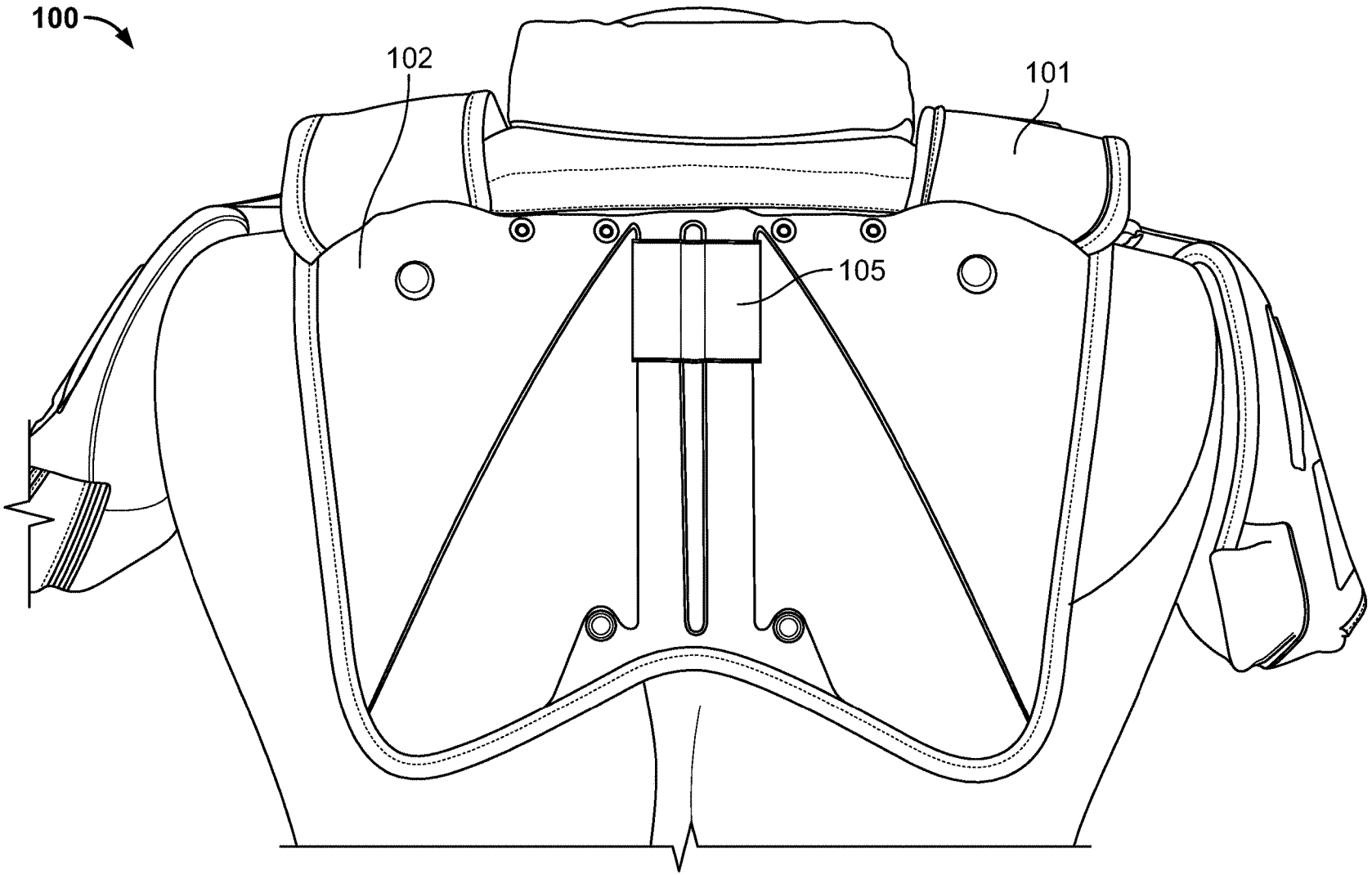
FIG. 10 is another rear view of the upper protector.
Figure 11:
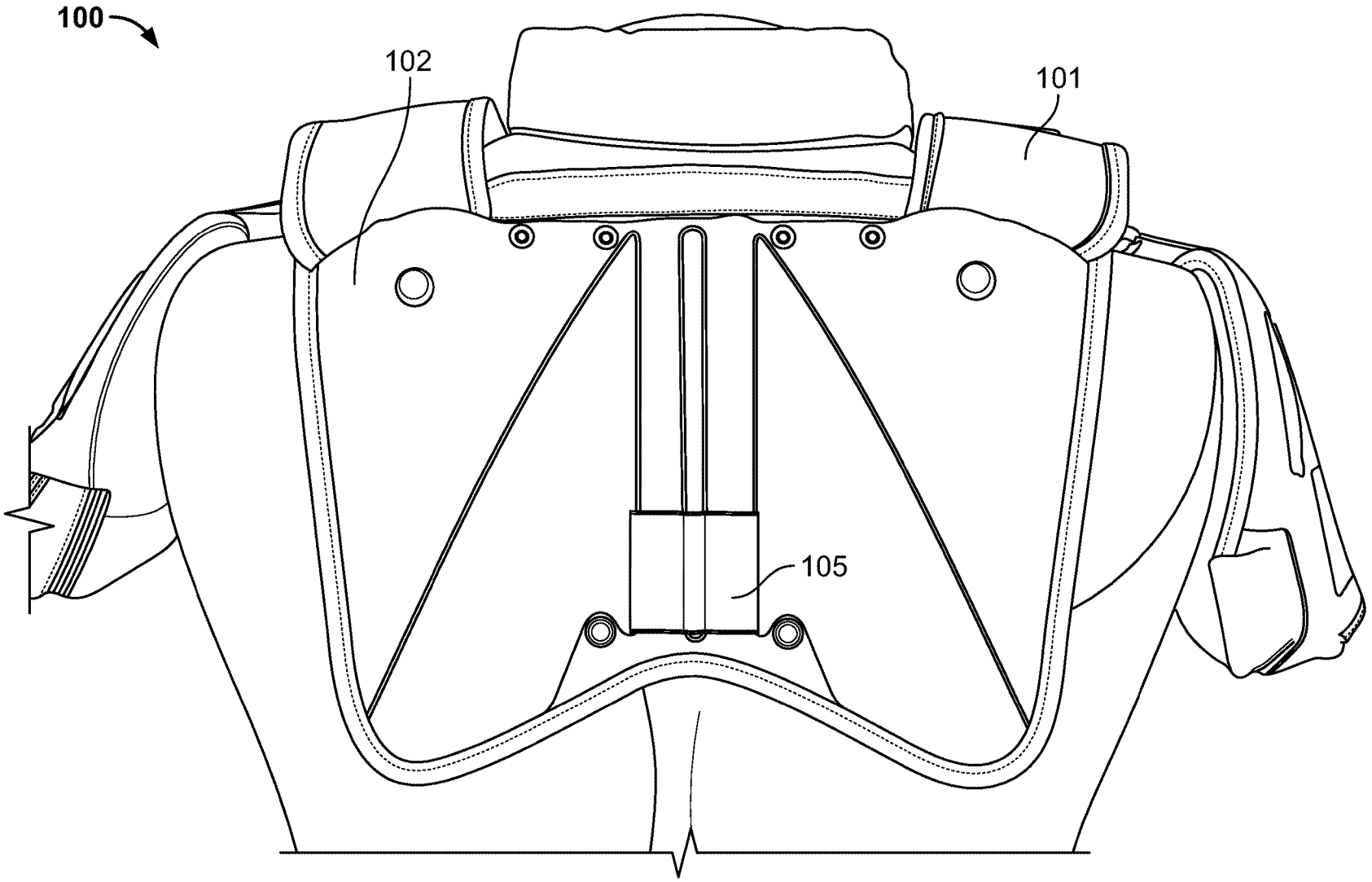
FIG. 11 is yet another rear view of the upper protector.
Figure 12:
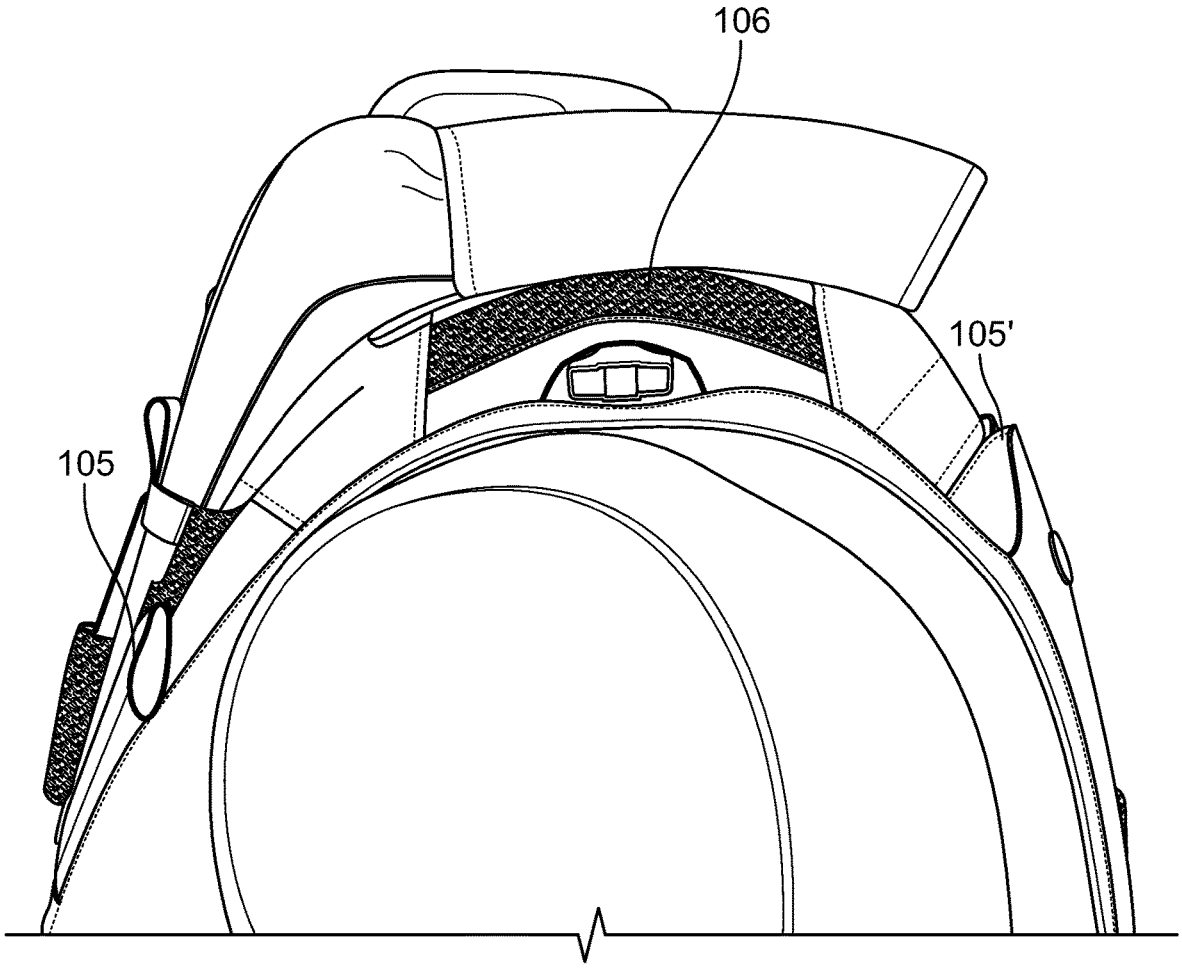
FIG. 12 is a side view of the upper protector.
Figure 13:
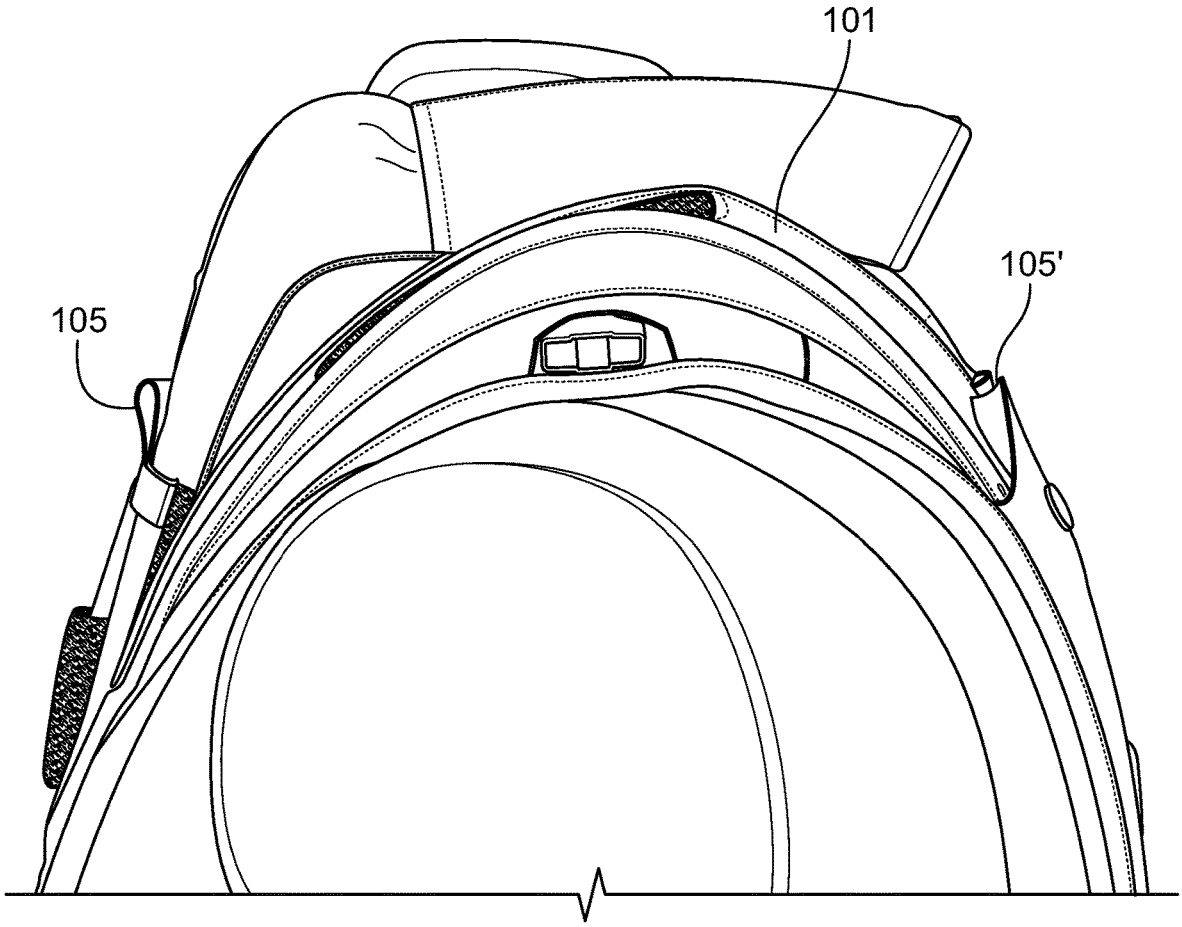
FIG. 13 is a side view of the upper protector with the shoulder suspension members inserted therein.
Figure 14:
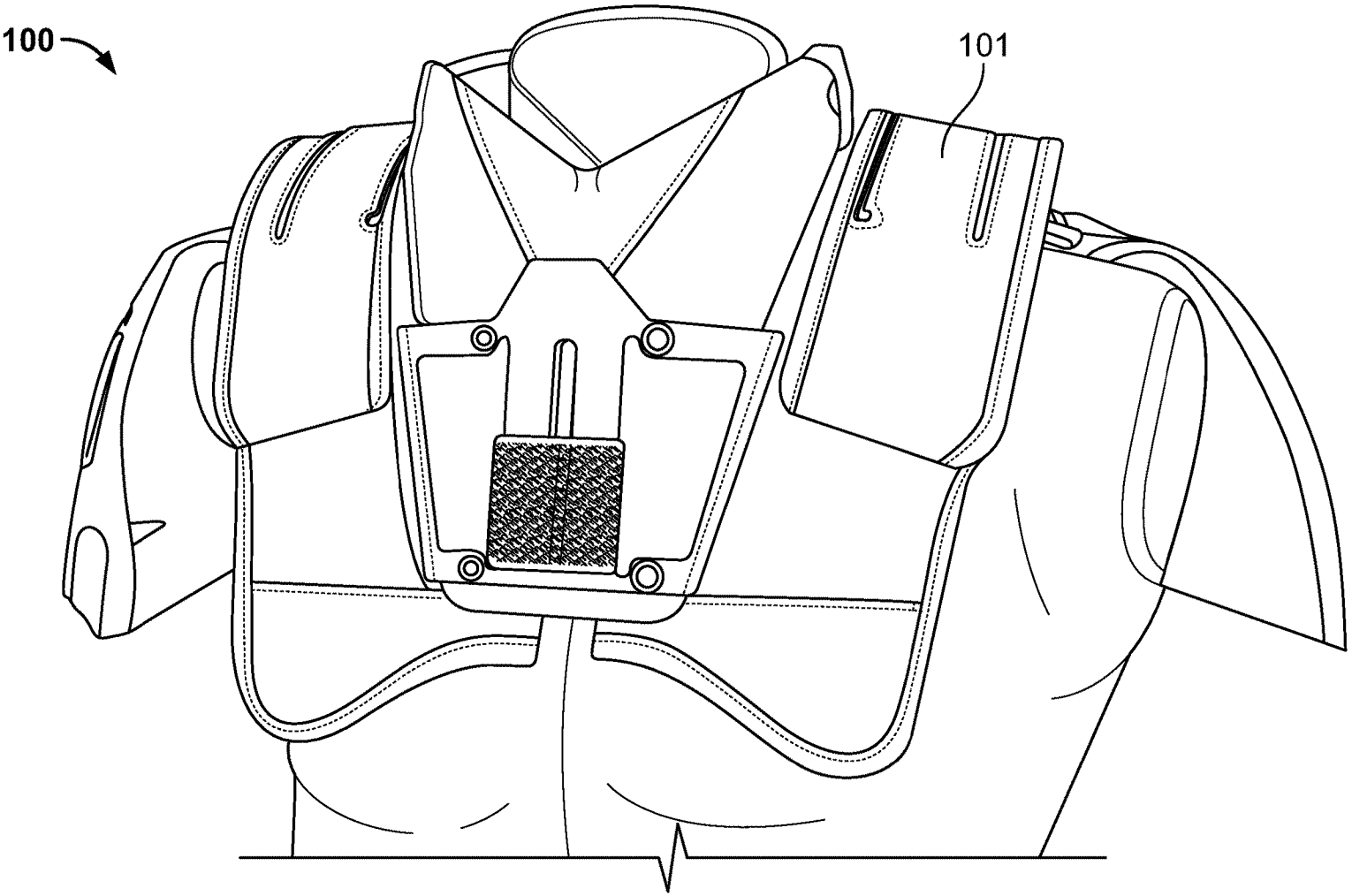
FIG. 14 is an isometric view of the upper protector with the shoulder suspension members inserted therein.

With reference to FIGS. 12-14 shown are side views of the mantel 100. In some embodiments, hook and loop fastener 106 is provided at the top of the shoulder area which is configured to engage corresponding shoulder straps of the armor carrier 200 in certain configurations. Also show are front and rear openings 105 and 105' which receive the ends of the shoulder suspension member 101 as shown in FIG. 10. In some embodiments, the shoulder suspension member 101 is a removable, semi-rigid support that helps distribute the load across the wearers shoulders caused by the weight of the armor carrier 200 when the carrier is installed over the upper protector 100. As shown, for example in FIG. 13, in some embodiments, at least a portion of the shoulder suspension member 101 is raised above the surface of the yoke 102.

The mantel and accessory hub 100 is configured to function as a primary point of attachment of various accessories, including those described herein such as the throat guard and deltoid/bicep protectors so that the system functions in a modular manner and avoids the need to move such accessories back and forth between bulkier armor carriers. In this way, the mantel and accessory hub 100 is intended to be worn underneath an armor carrier or plate carrier while retaining the desired accessories to allow for selective use of a desired armor carrier without having to reposition or re-attach the accessories to that armor carrier. Accordingly, in some embodiments the mantel and accessory hub 100 does not include hard armor, i.e. rigid plates. In some embodiments, the mantel and accessory hub 100 does not include pockets that would otherwise be designed to intended to receive hard armor. Also, given a use case wherein the mantel and accessory hub 100 is designed as a modular system worn underneath a larger and heavier armor carrier, in some embodiments, the primary yoke 102 covers only the thorax (upper back and upper chest area) of the wearer and, in some embodiments, does not extend to cover the abdomen, lower abdomen, middle back, or lower back areas of the wearer.

Removable Throat Guard

Figure 15:
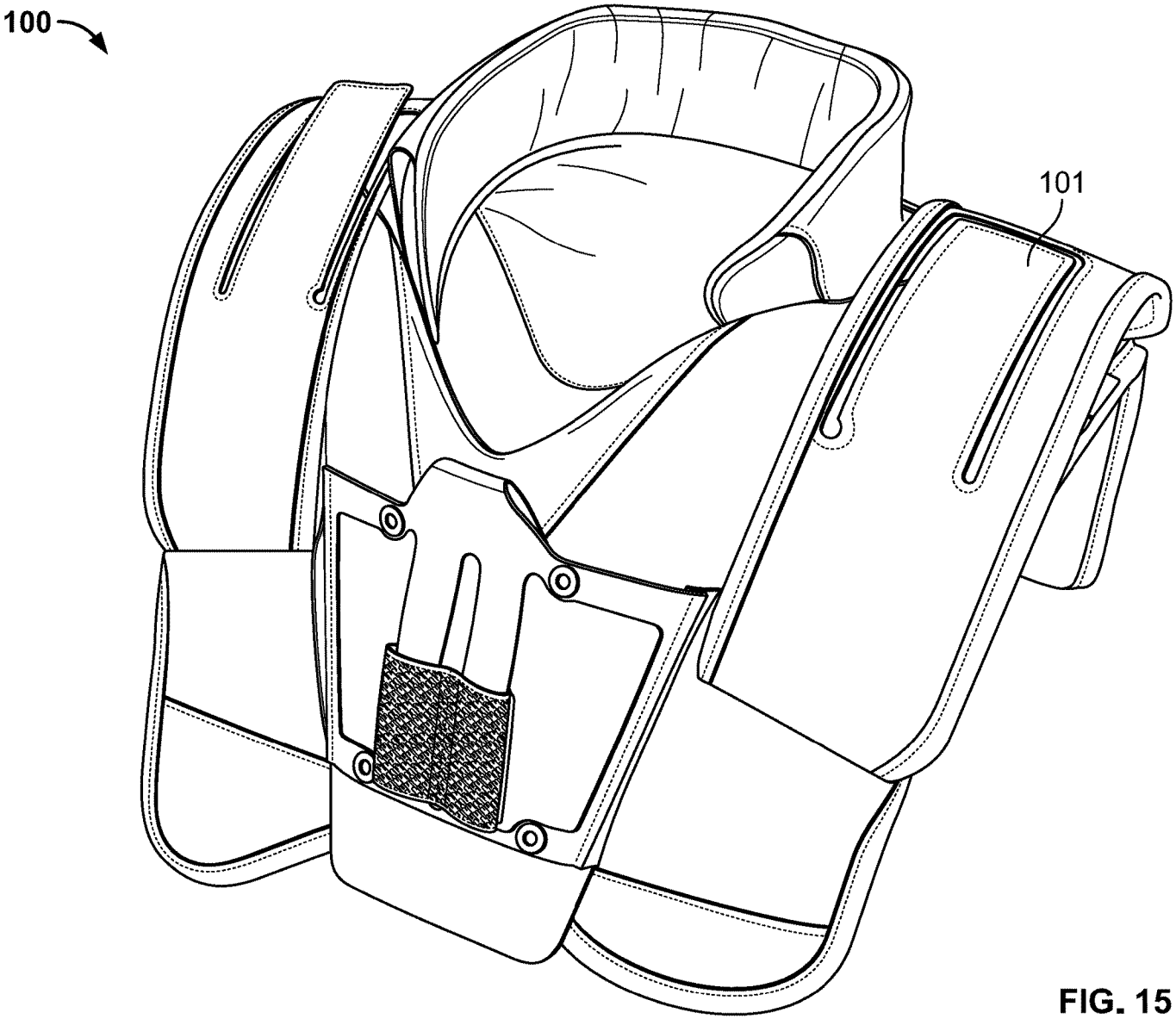
FIG. 15 is an isometric view of the upper protector with the throat guard removed.
Figure 16:
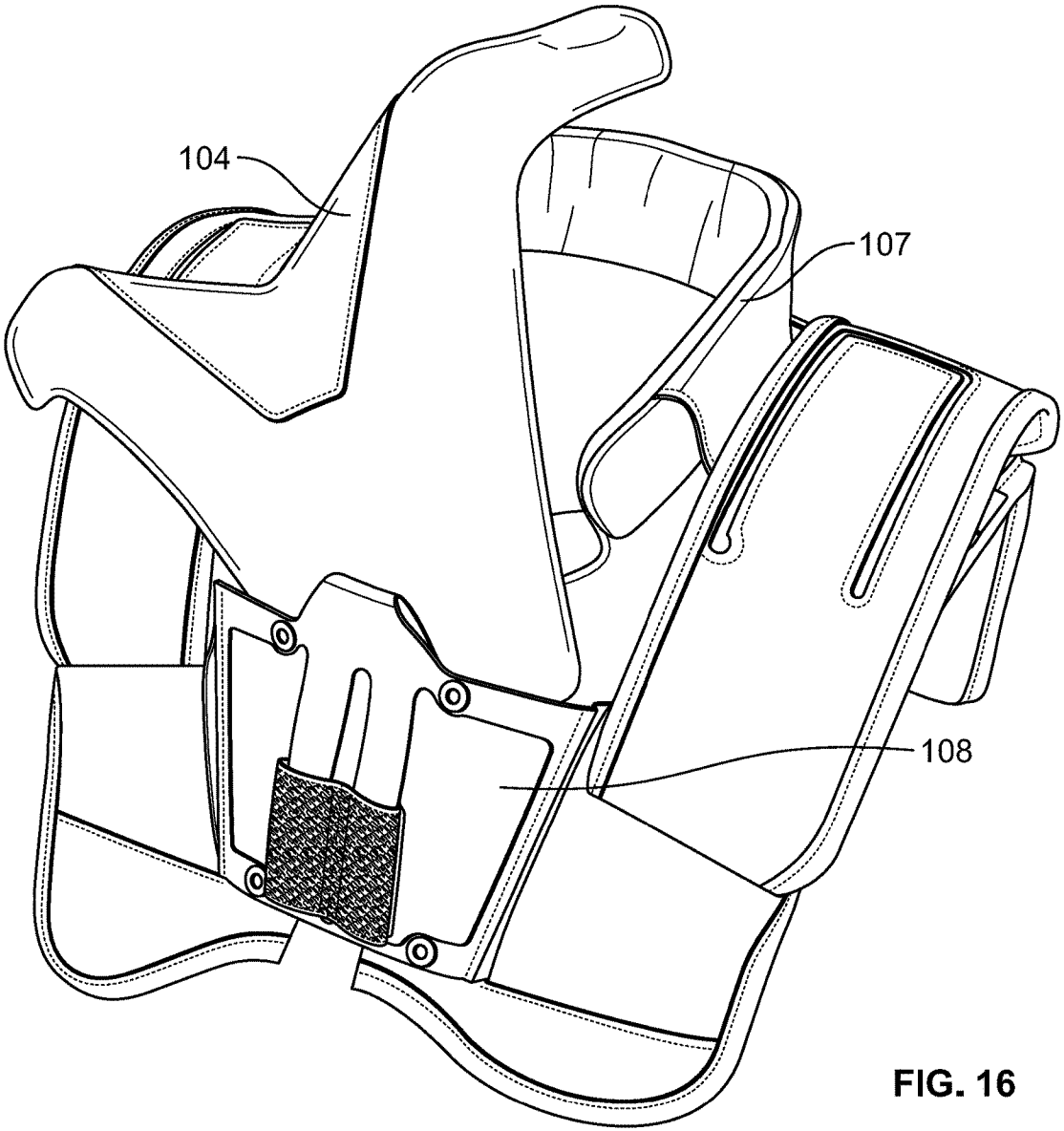
FIG. 16 shows a step of the insertion of the throat guard into the upper protector.
Figure 17:
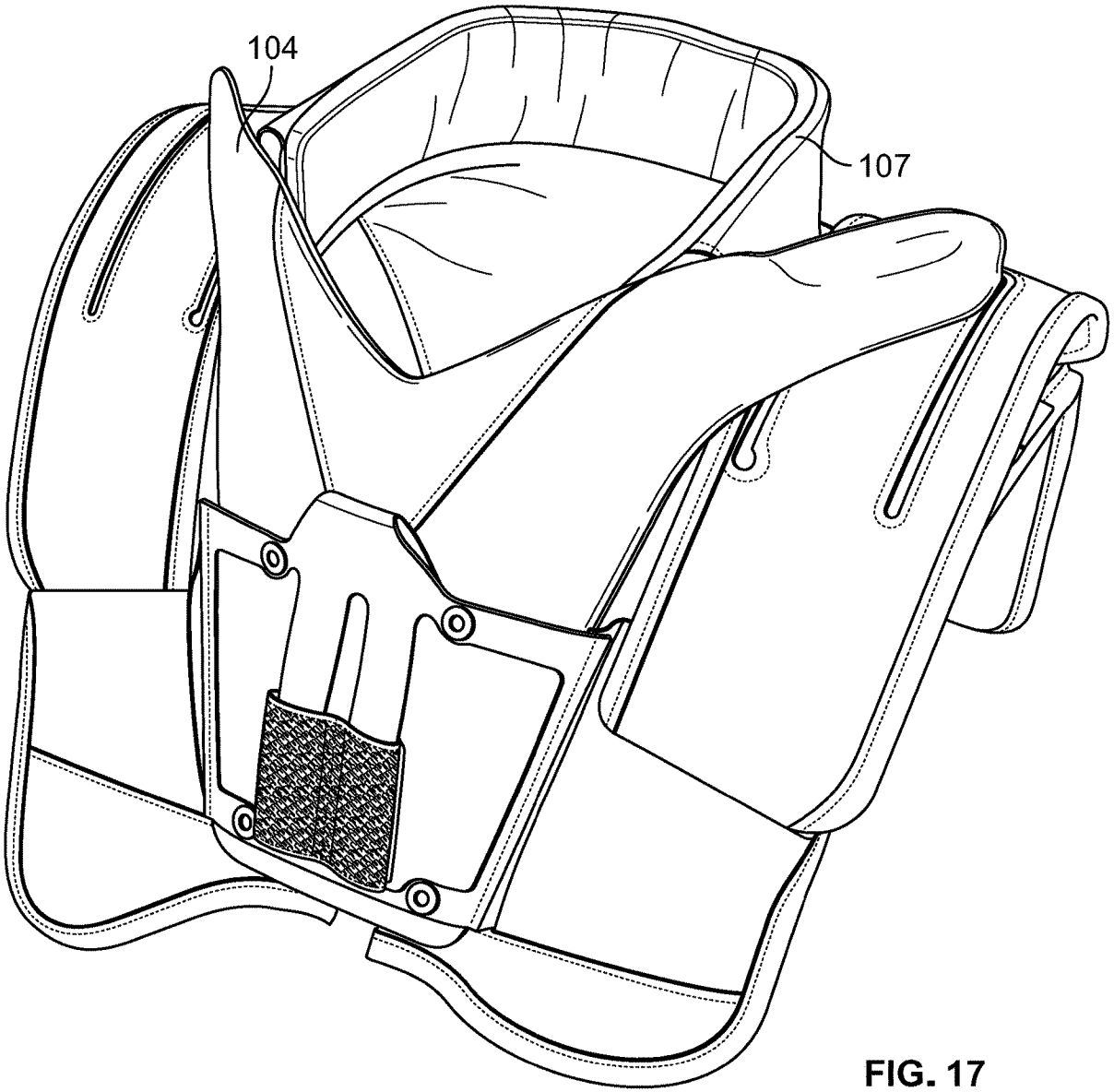
FIG. 17 shows another step of the insertion of the throat guard into the upper protector.
Figure 18:
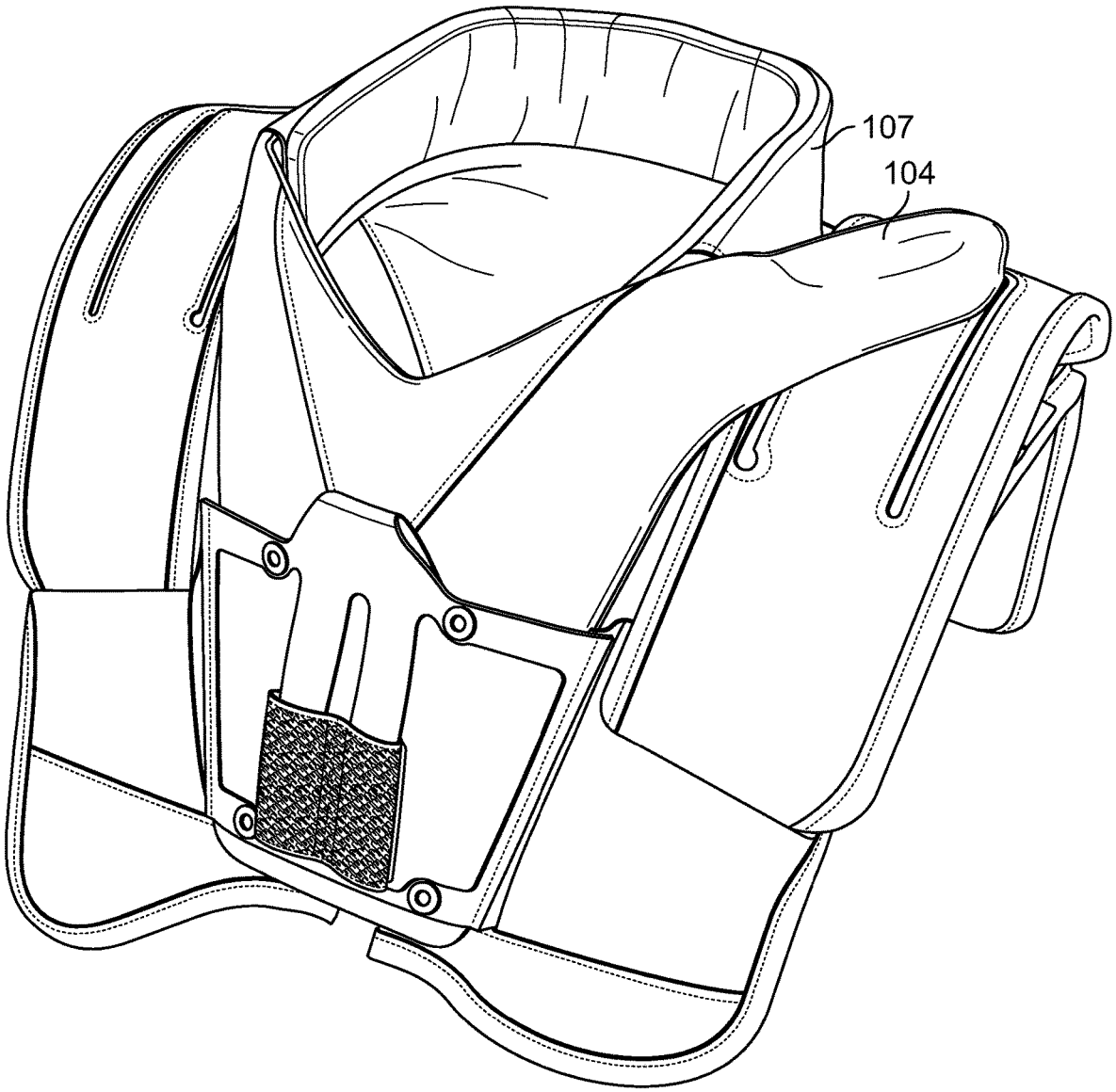
FIG. 18 shows yet another step of the insertion of the throat guard into the upper protector.
Figure 19:
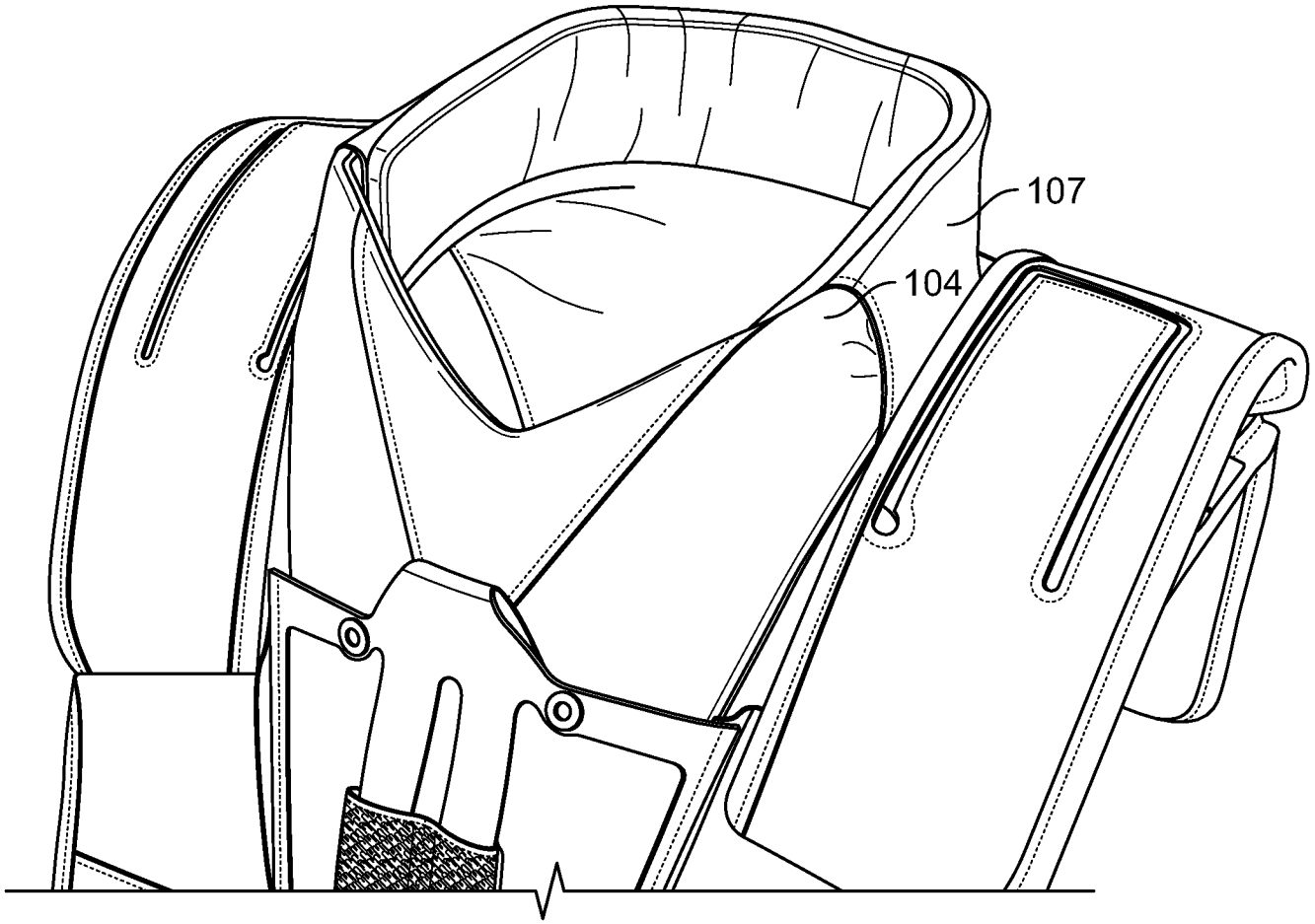
FIG. 19 is an isometric view of the upper protector with the throat guard installed.

With reference to FIGS. 15-19, the functionality of the removable throat guard 104 is shown. In FIG. 15, the throat guard 104 is completely removed from the upper protector 100. In some embodiments, the throat guard 104 is generally V-shaped with two upper horns that is received into the collar 107 of the upper protector 100 and a bottom portion that is received into a central panel 108 of the upper protector 100. In some embodiments, the central panel 108 comprises or includes a pocket (where 108 points) to receive the bottom portion of the throat guard 104. FIG. 19 shows the throat guard 104 in its fully installed position.

Lateral Expansion for Comfort and Mobility

Figure 21:
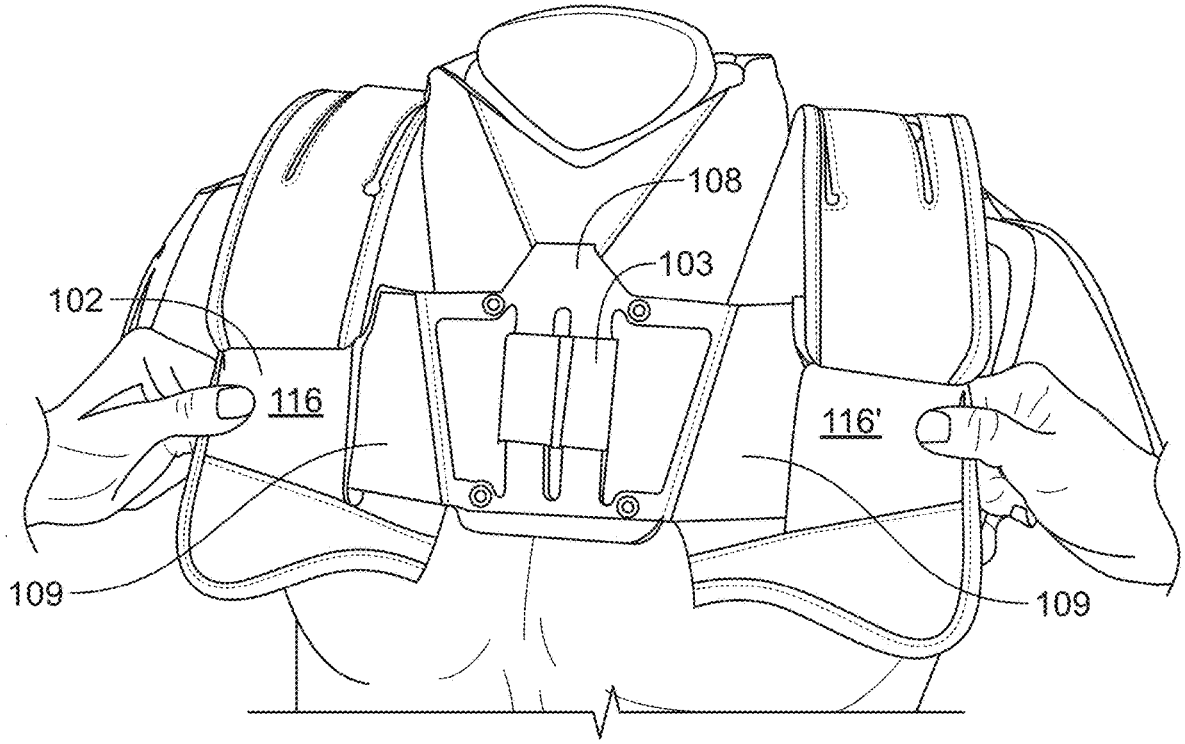
FIG. 21 shows a lateral expansion feature of the upper protector.

FIGS. 20-21 depict a lateral expansion feature of the upper protector which aids in the comfort and mobility of the wearer. Shown is the front of the yoke 102 with the central panel 108 disposed between the respective sides 116 and 116' at the front of the yoke 102. In this way, it is shown that, in some embodiments, the yoke 102 comprises one-piece element covering the thorax of the wearer except for an opening delimited by the respective sides 116 and 116' which, in some embodiments are disposed at the front of the yoke 102 (See FIG. 21). In some embodiments, sewn between the central panel 108 and the respective sides 116 and 116' of the yoke 102 is a resilient elastic material 109 which allows the sides 116 and 116' of the yoke 102 to expand and contract relative to the central panel 108. Accordingly, in some embodiments, the central panel 108 is suspended by the resilient elastic material in the opening delimited by the respective sides 116 and 116'. This expansion feature also aids the wearer in donning or doffing the upper protector or mantel and/or accessory hub 100 by providing more room and adjustability. Alternatively, the resilient elastic material 109 could be substituted for a zipper or other expandable/contractable closure to assist the wearer in putting on and taking off the upper protector 100.

Deltoid Guard

Figure 22:
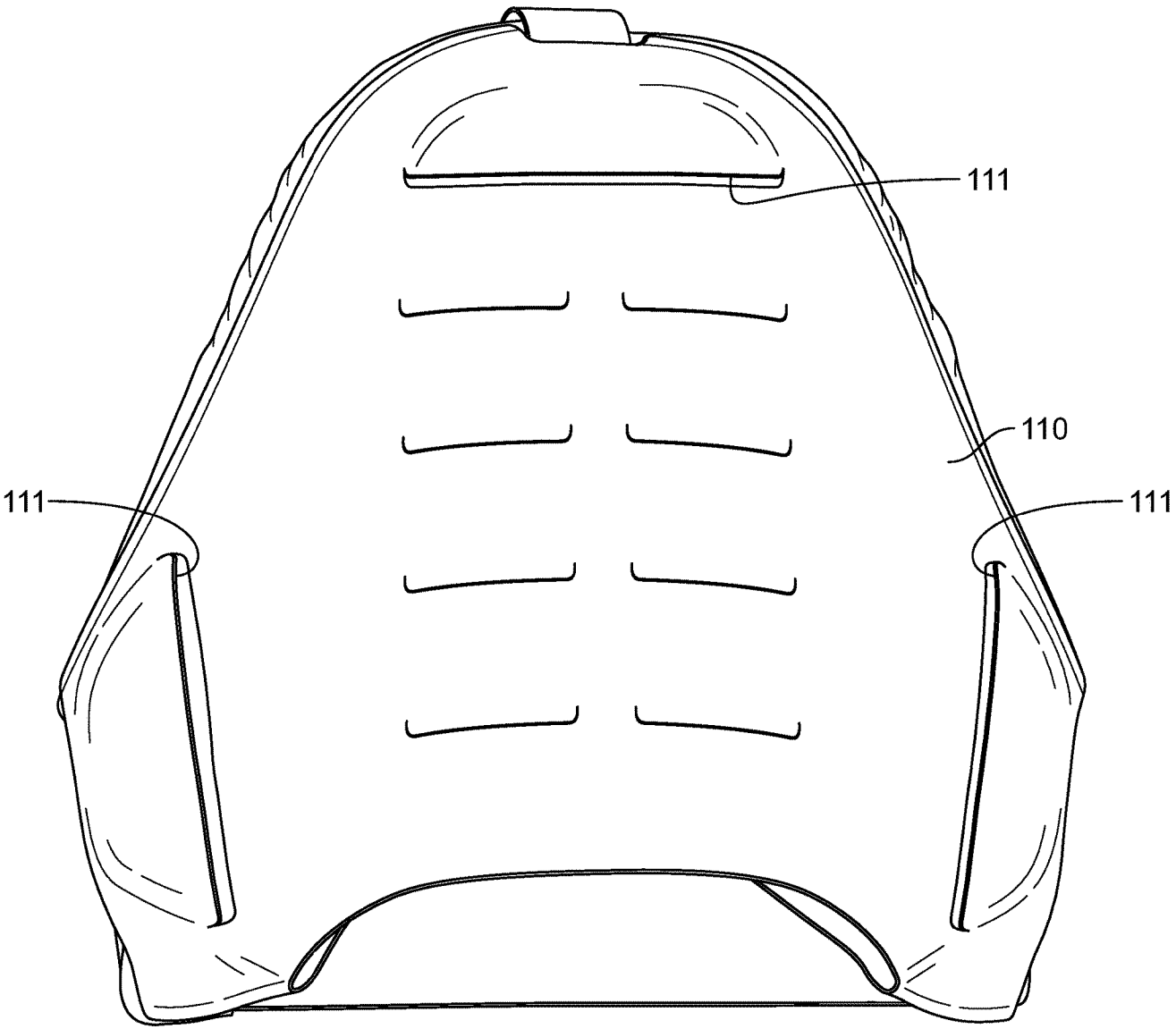
FIG. 22 is a front view of a deltoid guard.
Figure 23:
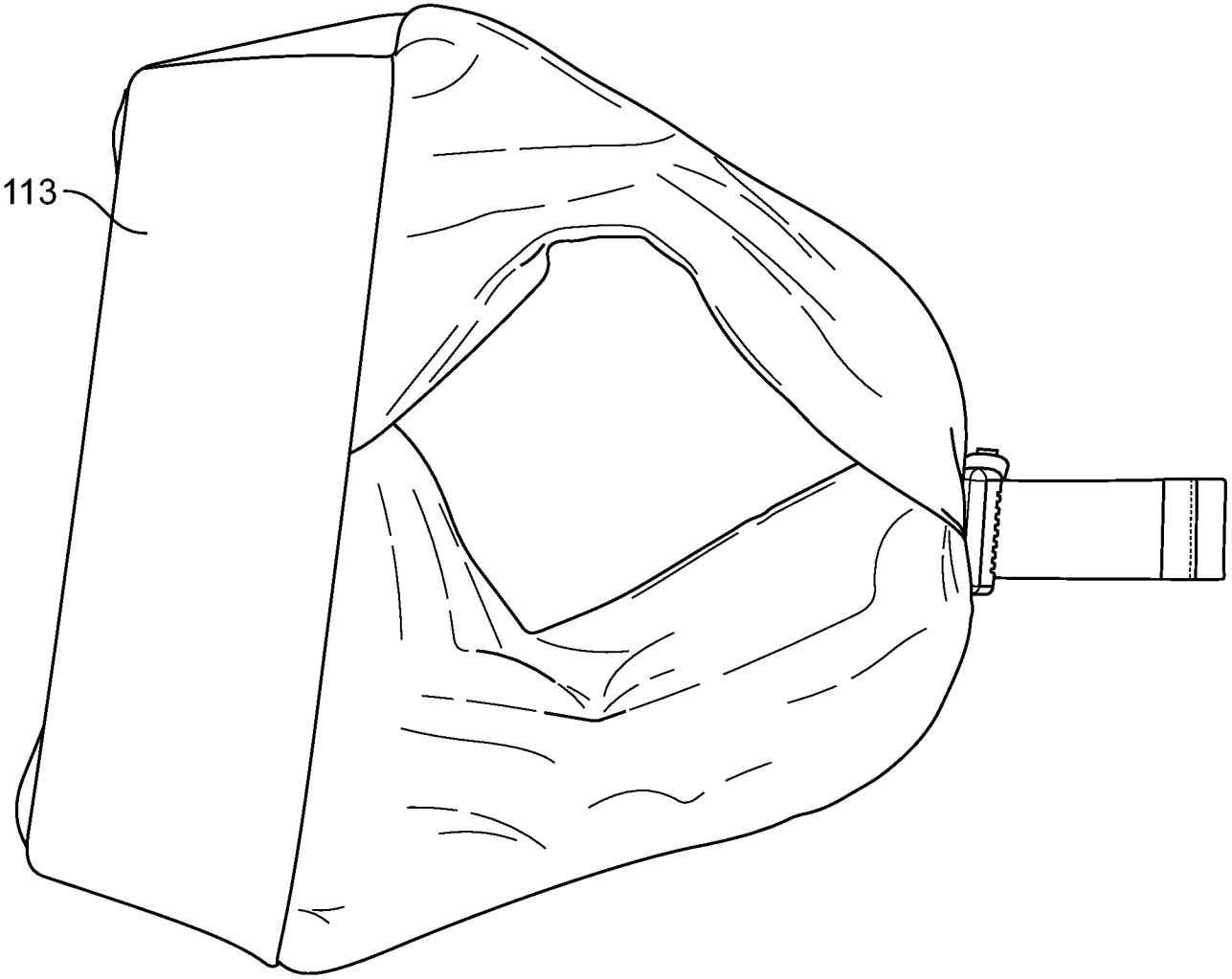
FIG. 23 is a rear view of the deltoid guard showing an open seam line for the insertion of body armor.
Figure 24:
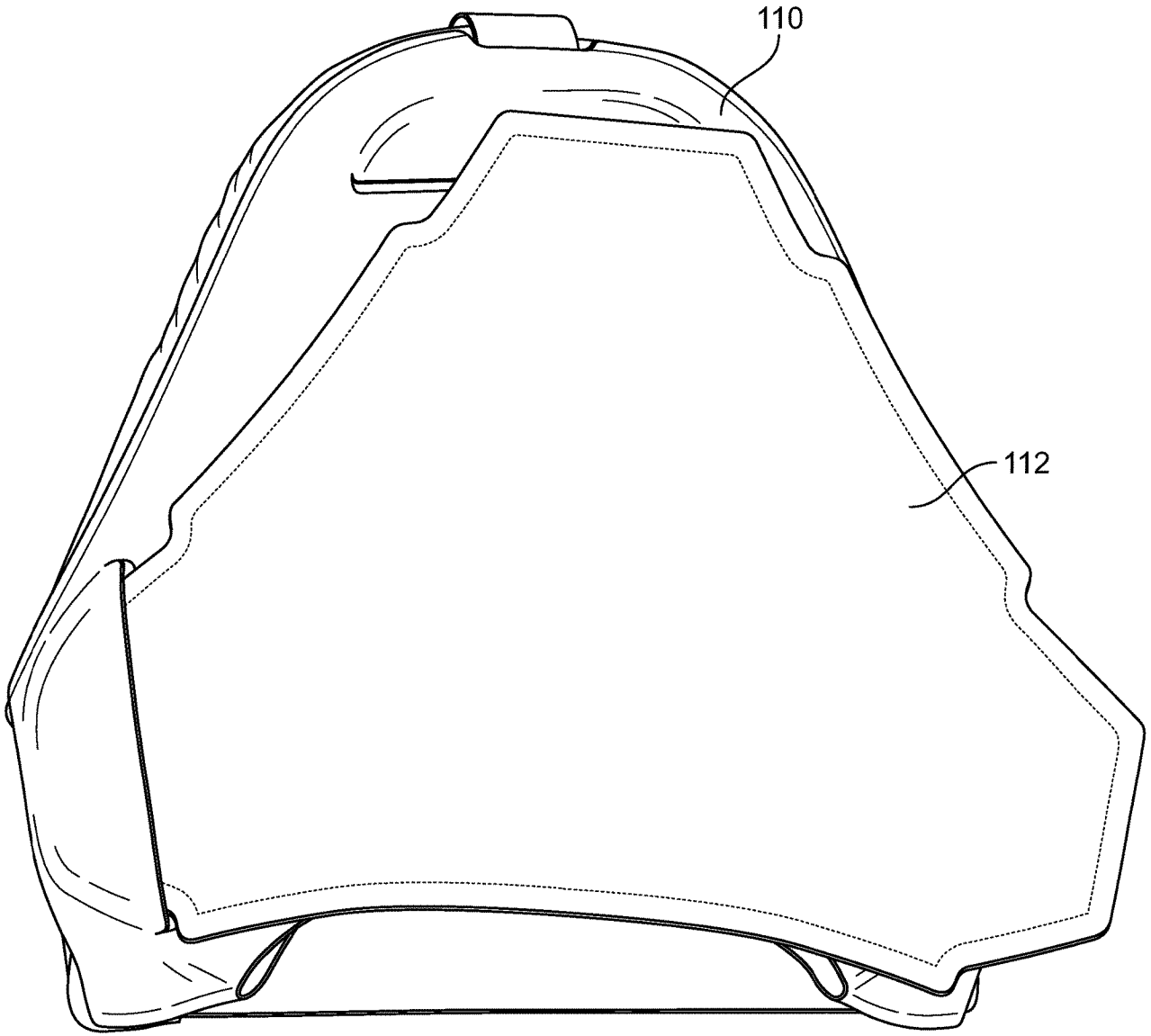
FIG. 24 shows the attachment of an identification panel onto the deltoid guard.
Figure 25:
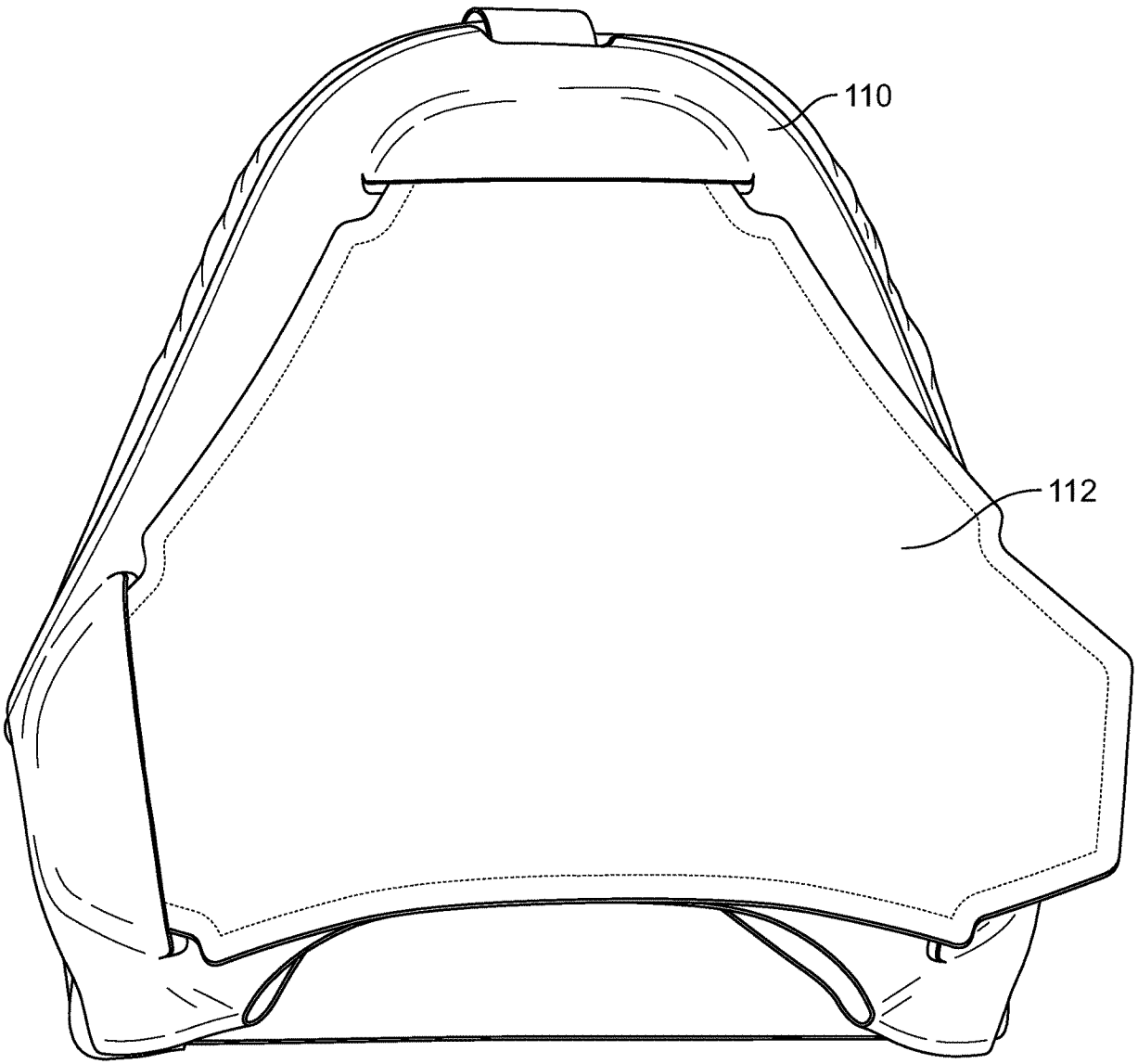
FIG. 25 shows the attachment of an identification panel onto the deltoid guard.
Figure 26:
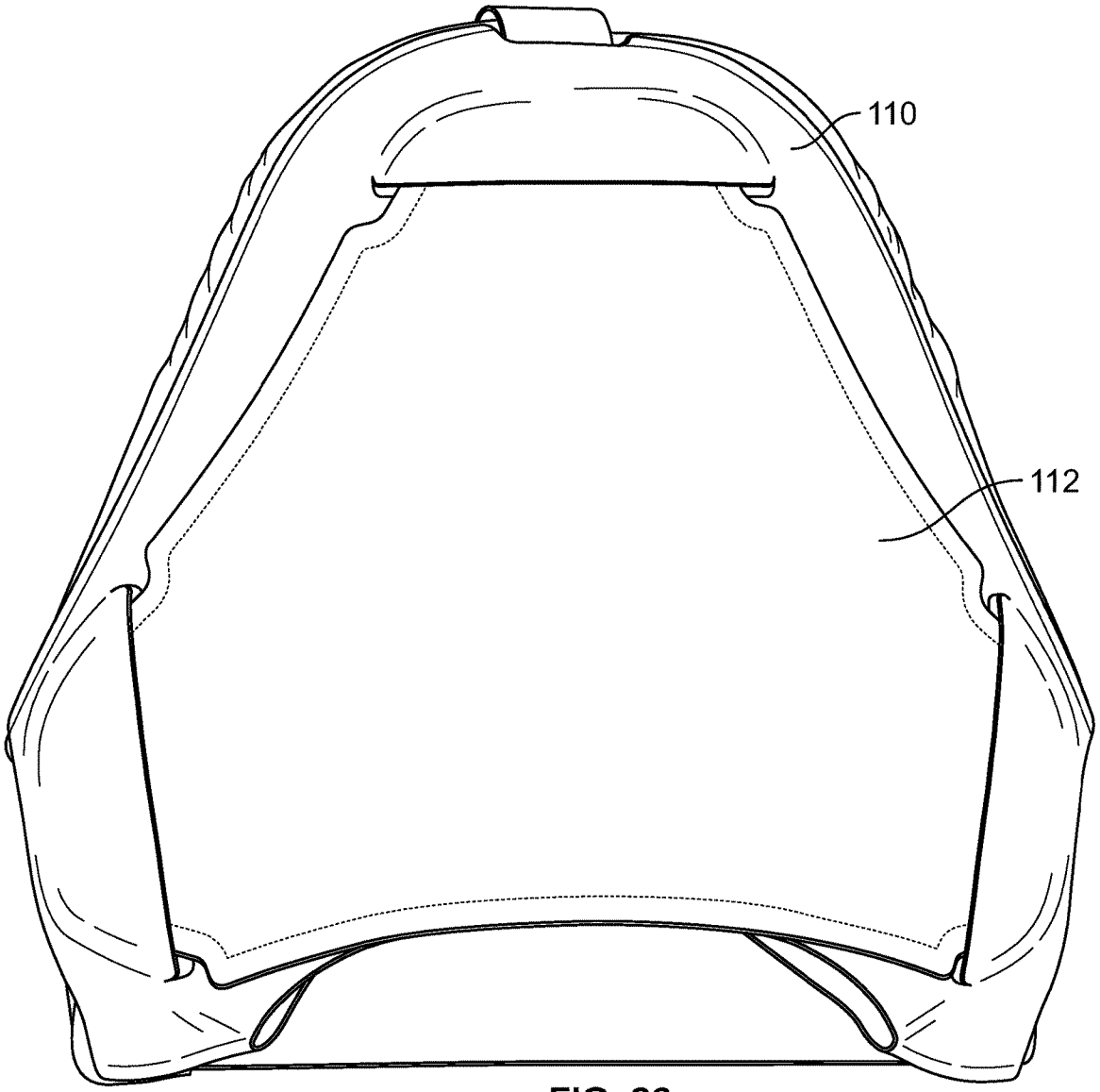
FIG. 26 shows the attachment of an identification panel onto the deltoid guard.

FIG. 22 is a front view of the deltoid guard 110, which has a generally triangular or trapezoidal shape and, in some embodiments, has one or more openings 111 which receive an identification panel 112. As shown in FIG. 23, the interior of the deltoid guard 110 is configured to receive and retain soft armor, hard armor, fragmentation armor, or combinations thereof. Also at the rear of the deltoid guard 110 is an expandable element 113 such as an elastic strap which retains the guard against the arm of the wearer. FIGS. 24-26 depict an example of the attachment of a wedge-like identification panel 112 onto the deltoid guard, namely by inserting one or more corners or edges of the identification panel 112 into the one or more corresponding openings 111 on the deltoid guard. The identification panel 112 may be reversible and printable and may also include hook and loop fastener for additional adhesion to the deltoid guard 110. In some embodiments, however, hook and loop fastener is obviated due to the insertions of the corners or edges of the identification panel 112 into one or more corresponding openings 111 on the deltoid guard. The identification panel 112 can also be attached elsewhere on the body armor system.

Figure 27:
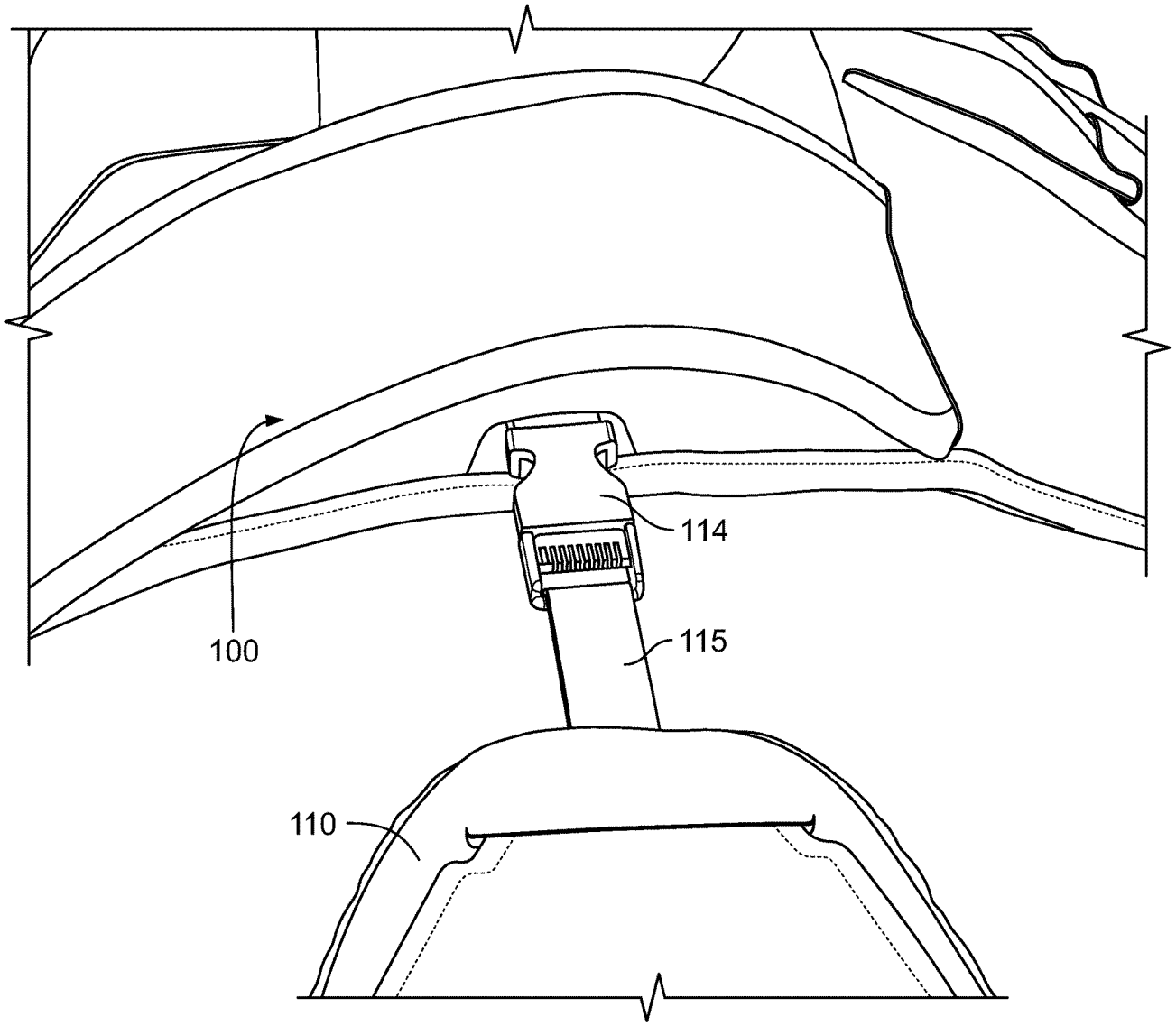
FIG. 27 shows the attachment of the deltoid guard to the upper protector.
Figure 28:
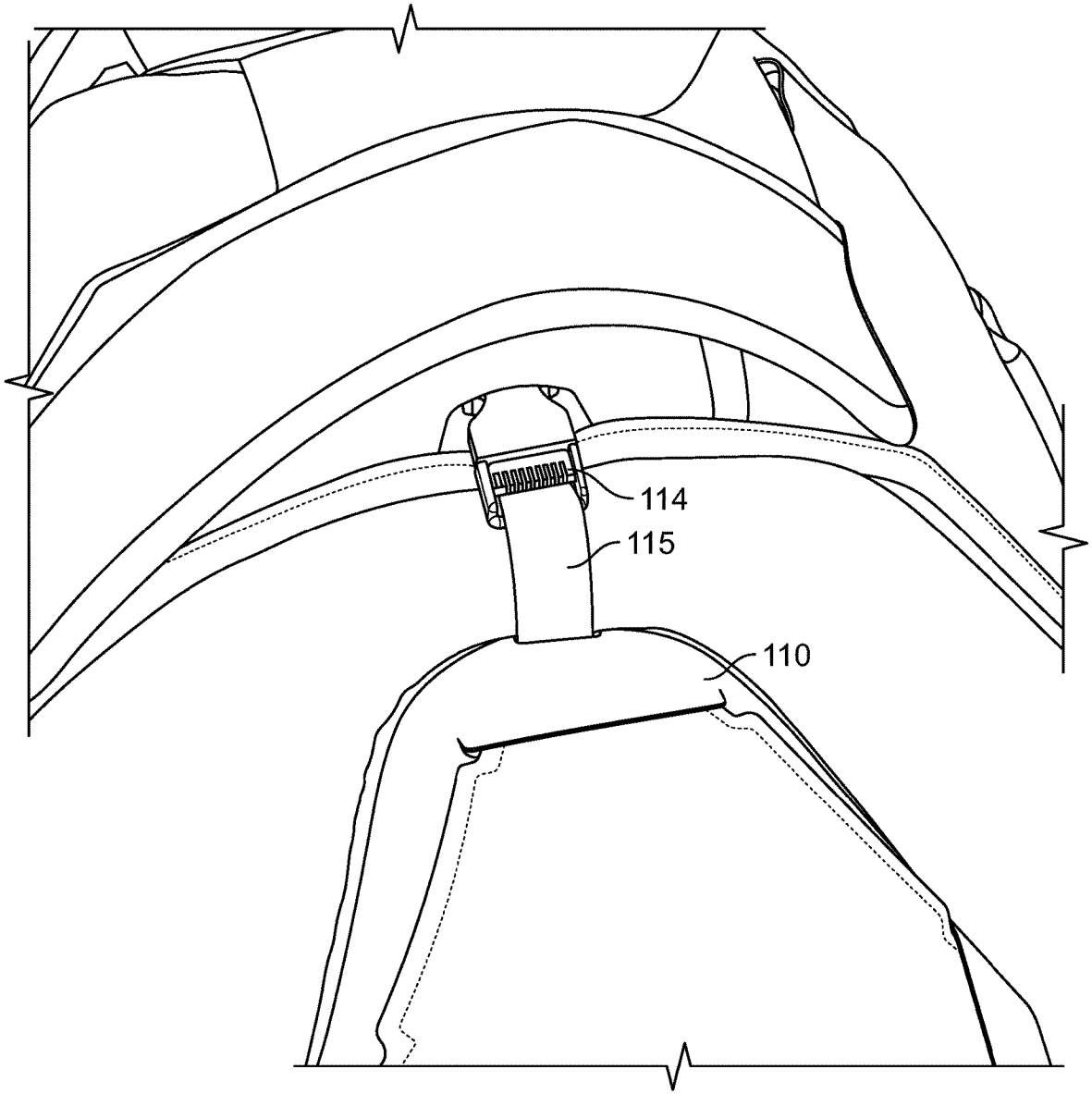
FIG. 28 shows the attachment of the deltoid guard to the upper protector.
Figure 29:
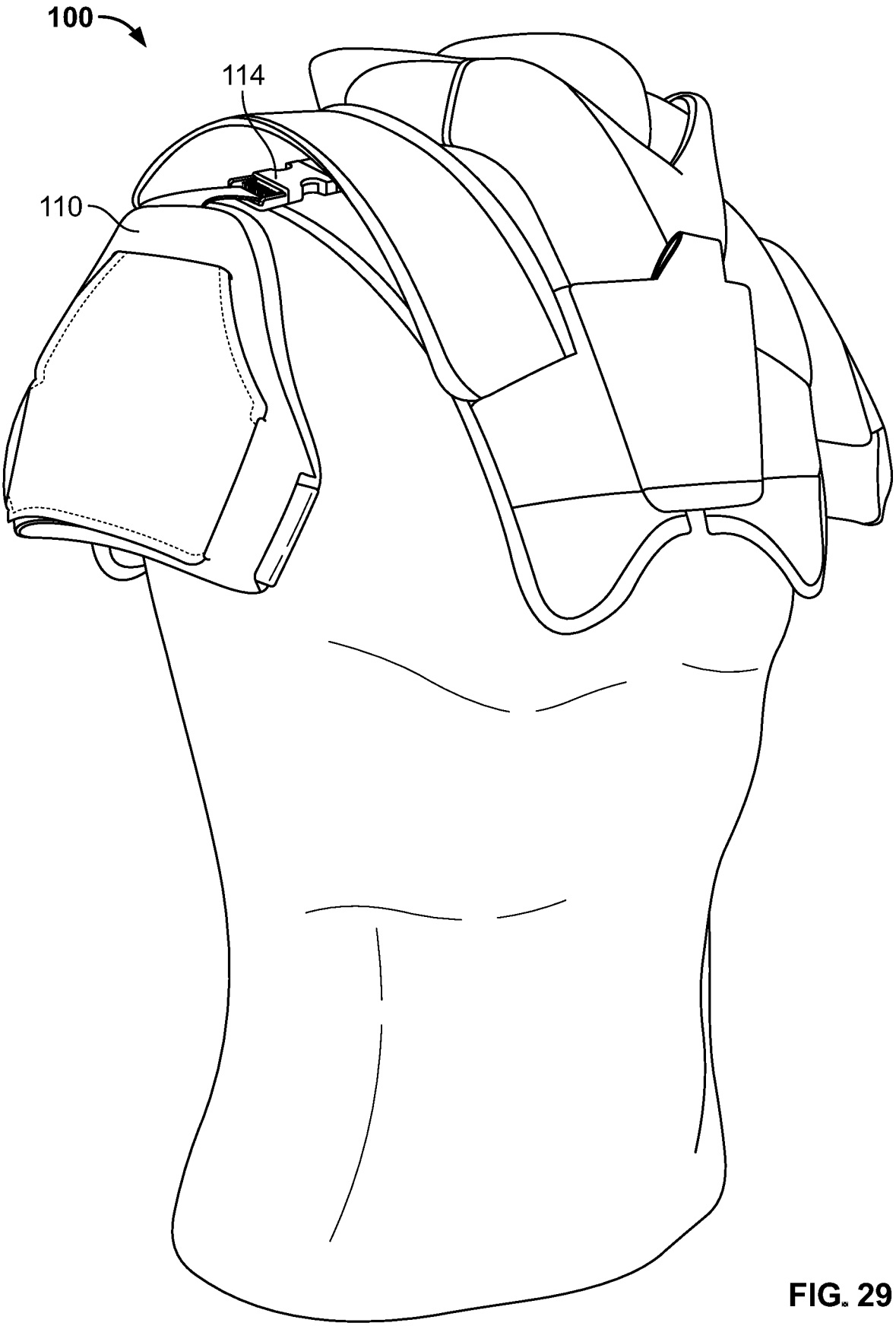
FIG. 29 shows the upper protector with the deltoid guard attached thereto.
Figure 30:
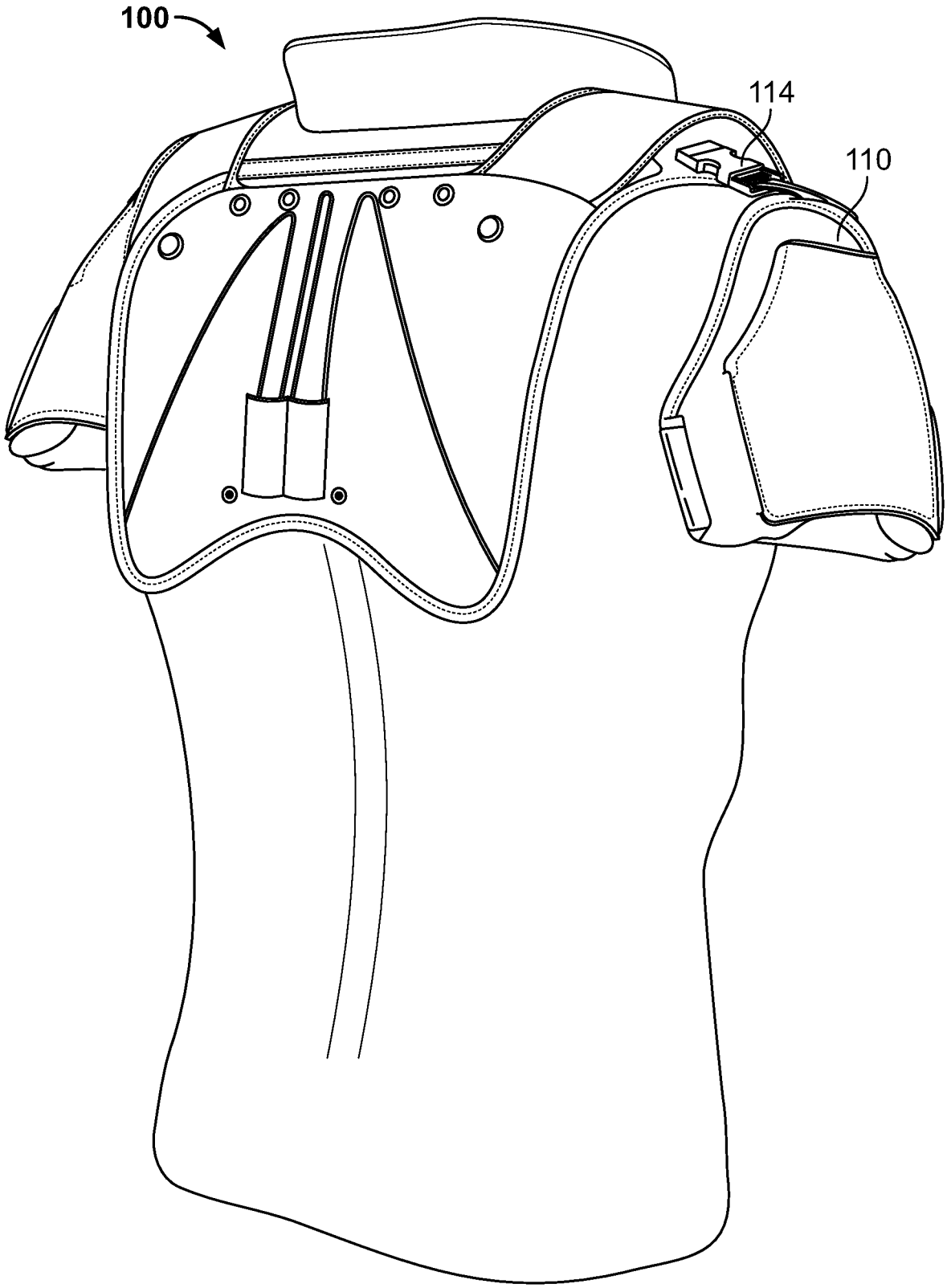
FIG. 30 shows the upper protector with the deltoid guard attached thereto.
Figure 31:
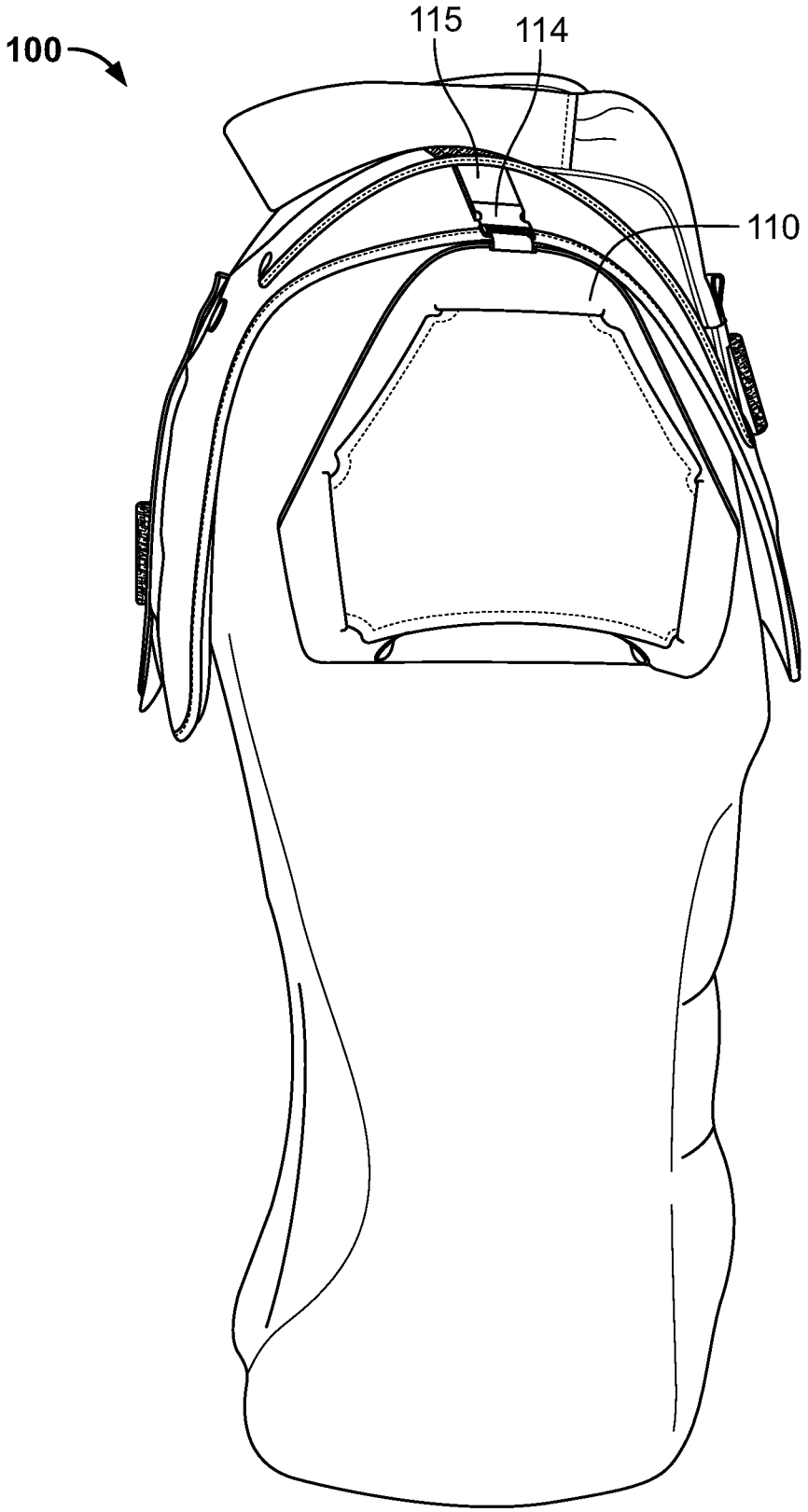
FIG. 31 shows the upper protector with the deltoid guard attached thereto.

FIGS. 27-28 depict the attachment of the deltoid guard 110 to the upper protector 100. In some embodiments, a small removable fastener 114 such as a buckle is attached at the shoulder area of the upper protector 100 which receives a corresponding fastener attached to the top of the deltoid guard 110. In other embodiments, the deltoid guard 110 may be fixed to the upper protector 100. In either configuration, an elastic material 115 may be provided at the connection to facilitate expansion and articulation of the deltoid guard 110 with respect to the upper protector 100 to aid wearer comfort. FIGS. 29-31 show various views the upper protector with the deltoid guard attached thereto.

In some embodiments, the deltoid guard 110 is relatively smaller than traditional designs and does not protect the bicep area in order to enhance mobility. However, as shown in FIG. 44, a supplemental bicep guard 110' may be implemented, which attaches to the deltoid such that the bicep guard can articulate with respect to the deltoid guard. In some embodiments, the bicep guard 110' is disposed at least partially underneath the deltoid guard 110 and attaches either to the deltoid guard or the upper protector by a buckle, elastic, and/or wedge received in an opening on the deltoid protector and/or the upper protector. This allows for a modular, scalable arm protection system that maximizes comfort and mobility.

Armor Carrier

Figure 32:
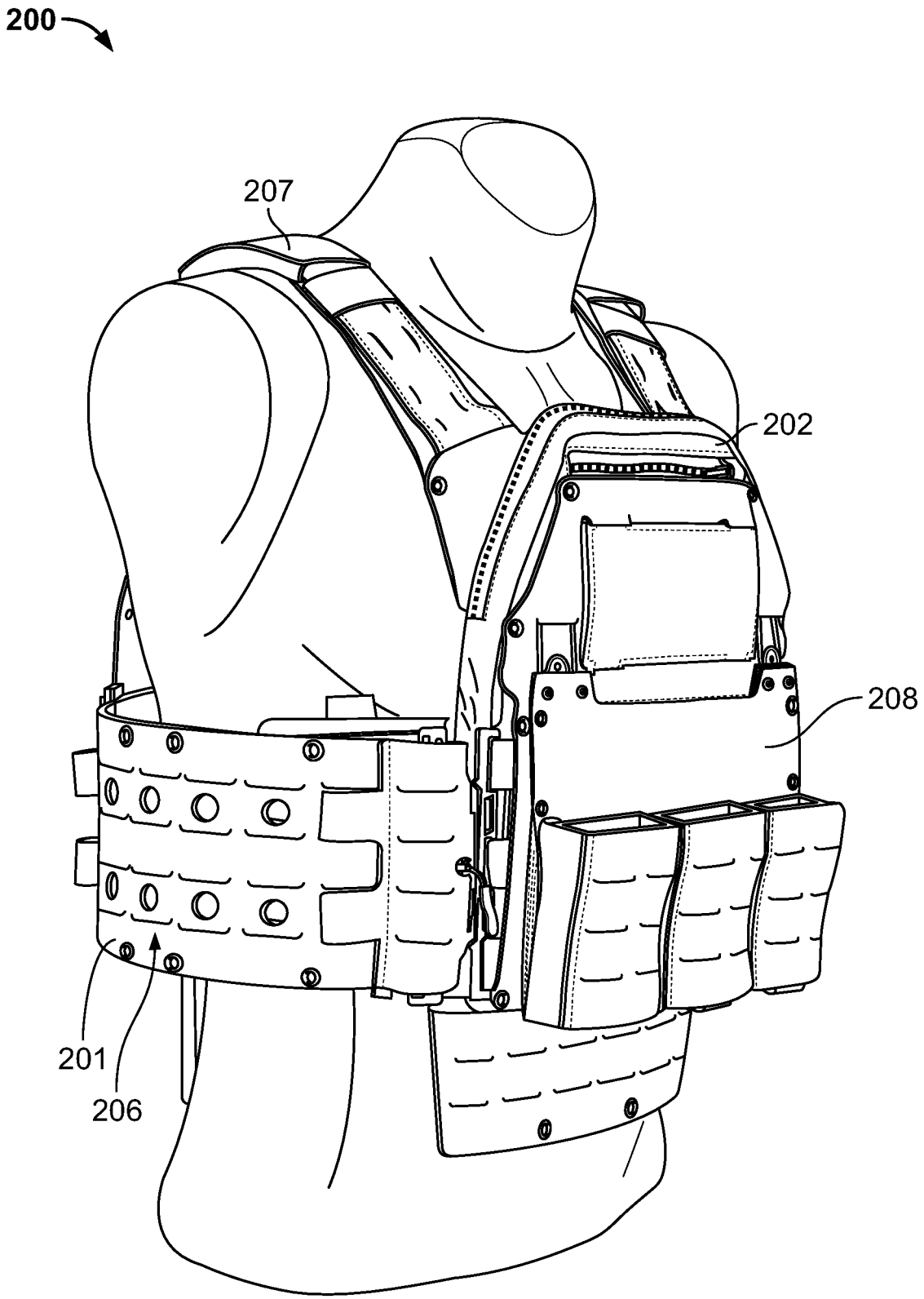
FIG. 32 is a front isometric view of the armor carrier.
Figure 33:
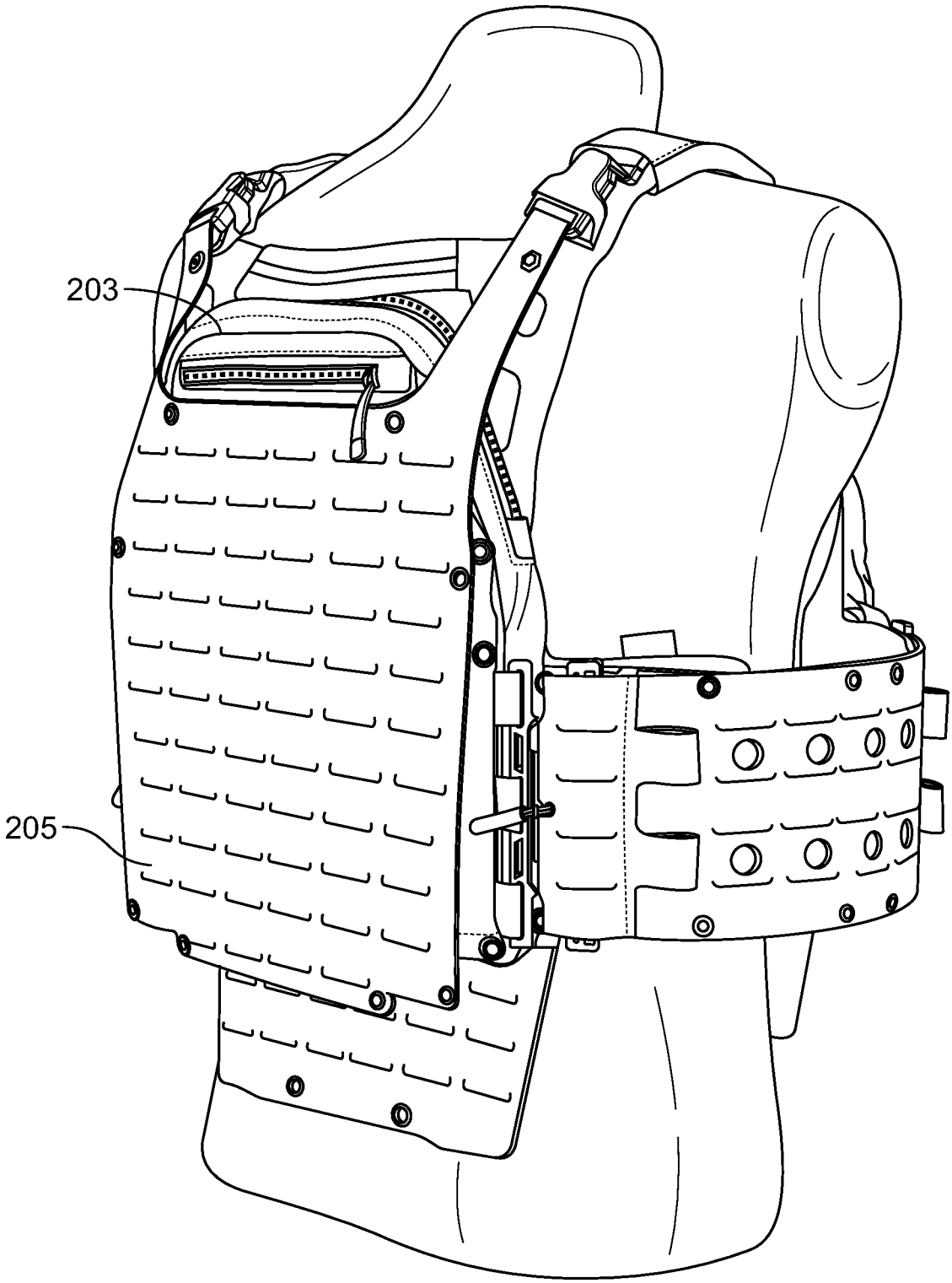
FIG. 33 is a rear isometric view of the armor carrier.
Figure 34:
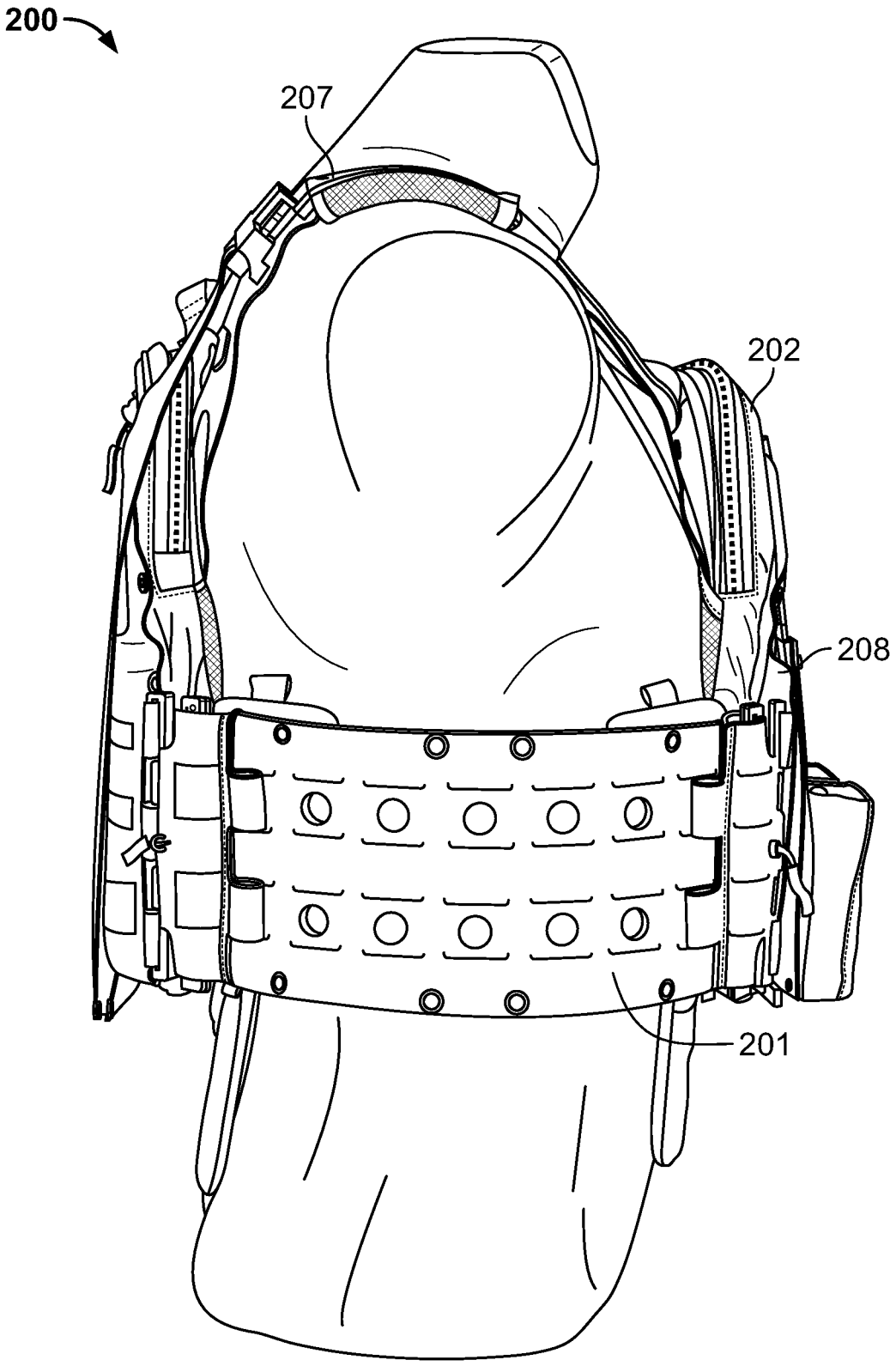
FIG. 34 is a side view of the armor carrier.
Figure 35:
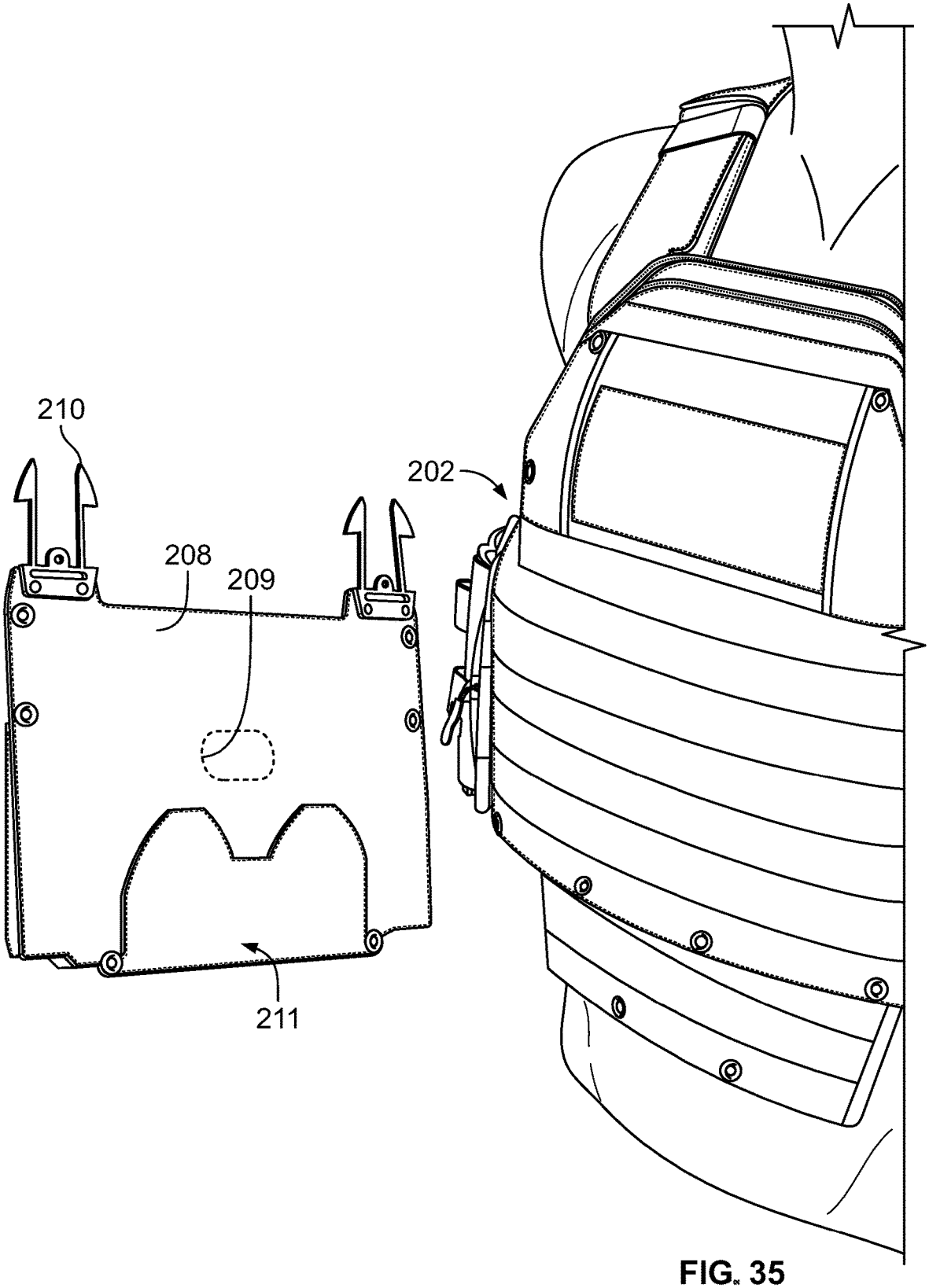
FIG. 35 shows a front accessory panel to be attached to the armor carrier.

With reference to FIGS. 32-34, in some embodiments the armor carrier 200 is configured to work in conjunction with the upper protector 100, with the armor carrier 200 placed over the upper protector 100. However, the armor carrier 200 can be used independently from the upper protector 100 in modular fashion as determined by the wearer, the circumstances, and the desired protection. The armor carrier 200 includes bi-lateral shoulder straps 207 which attach the front panel 202 to the back panel 203 at the top of the shoulders. In some embodiments, the shoulder straps 207 of the armor carrier 200 are adjustable by hook and loop fastener or other removable fasteners and the free ends can be tucked into corresponding openings on the front and/or back panels 202 and 203. Also provided are bi-lateral abdomen straps 201 which attach the front panel 202 to the back panel 203 around the lower thorax or abdomen of the wearer. The bi-lateral side straps 201 comprise and/or include an accessory modular accessory system 206. The armor carrier includes an optional font flap 208 and a rear flap 205 which are removably attached to the carrier 200. In some embodiments, the rear flap 205 is attached to the armor carrier 200 at the respective shoulder straps 207 by a fastener 204, such as by a buckle.

Accessory Panel

Figure 36:
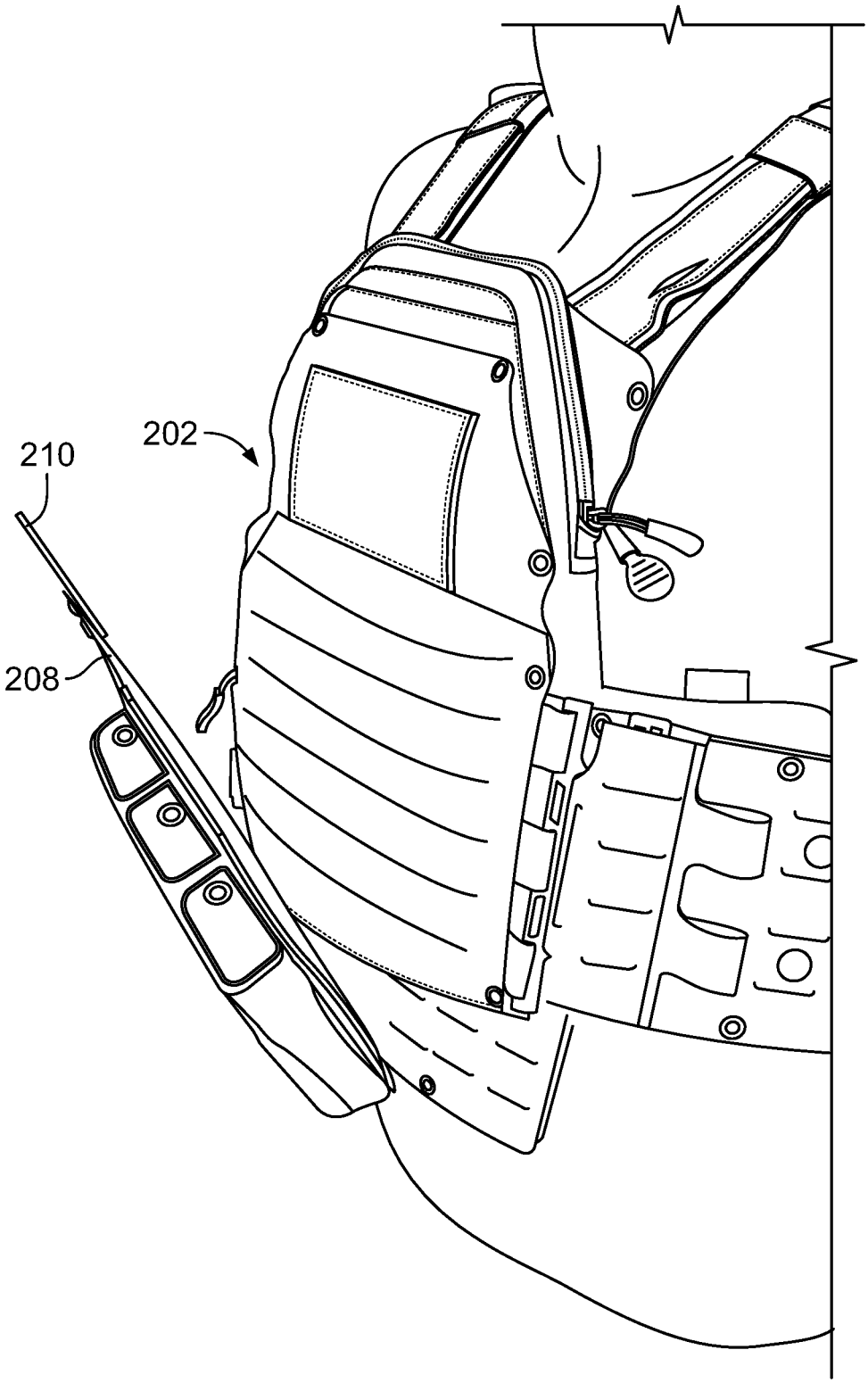
FIG. 36 shows the attachment of the front accessory panel to the armor carrier.

With reference to FIGS. 35-39, show in a front accessory panel 208 which is removably attached to the front panel 202 of the armor carrier. The front accessory panel 208 is configured to easily align and attach to the front panel 202 using magnetic and/or mechanical attachments. In some embodiments, the inside surface of the flap 208 includes one more magnets 209 which are configured to align and attach to corresponding magnets on the front accessory panel 208. In some embodiments, an interior aspect of the accessory panel 208 includes a raised wedge 211 which is received in a corresponding opening on the armor carrier, as shown in FIG. 36. In some embodiments, the wedge may be located on the armor carrier with the corresponding opening provided on the accessory panel 208.

Figure 37:
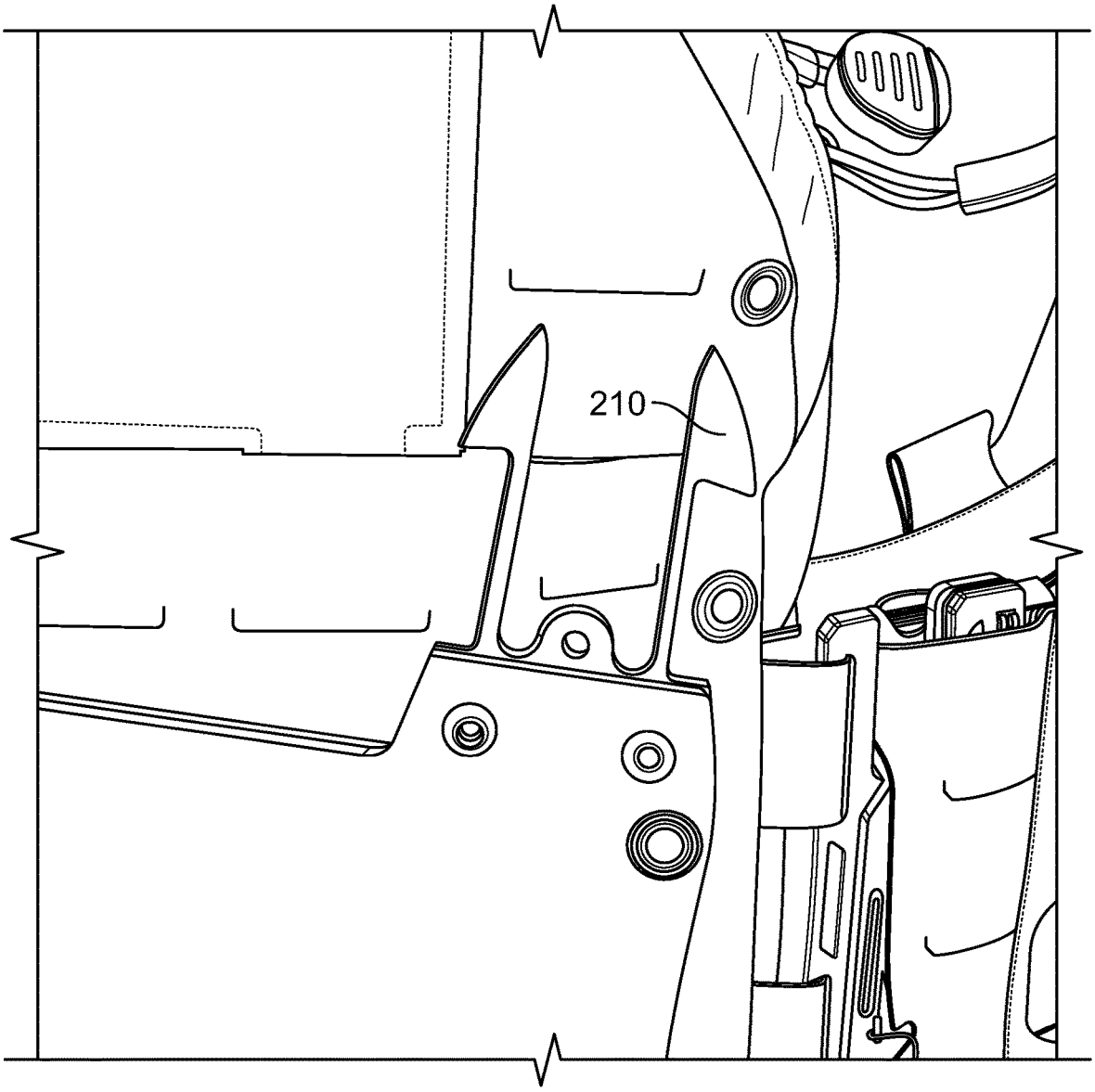
FIG. 37 shows the insertion of attachment members of the front accessory panel into corresponding openings on the armor carrier.
Figure 38:
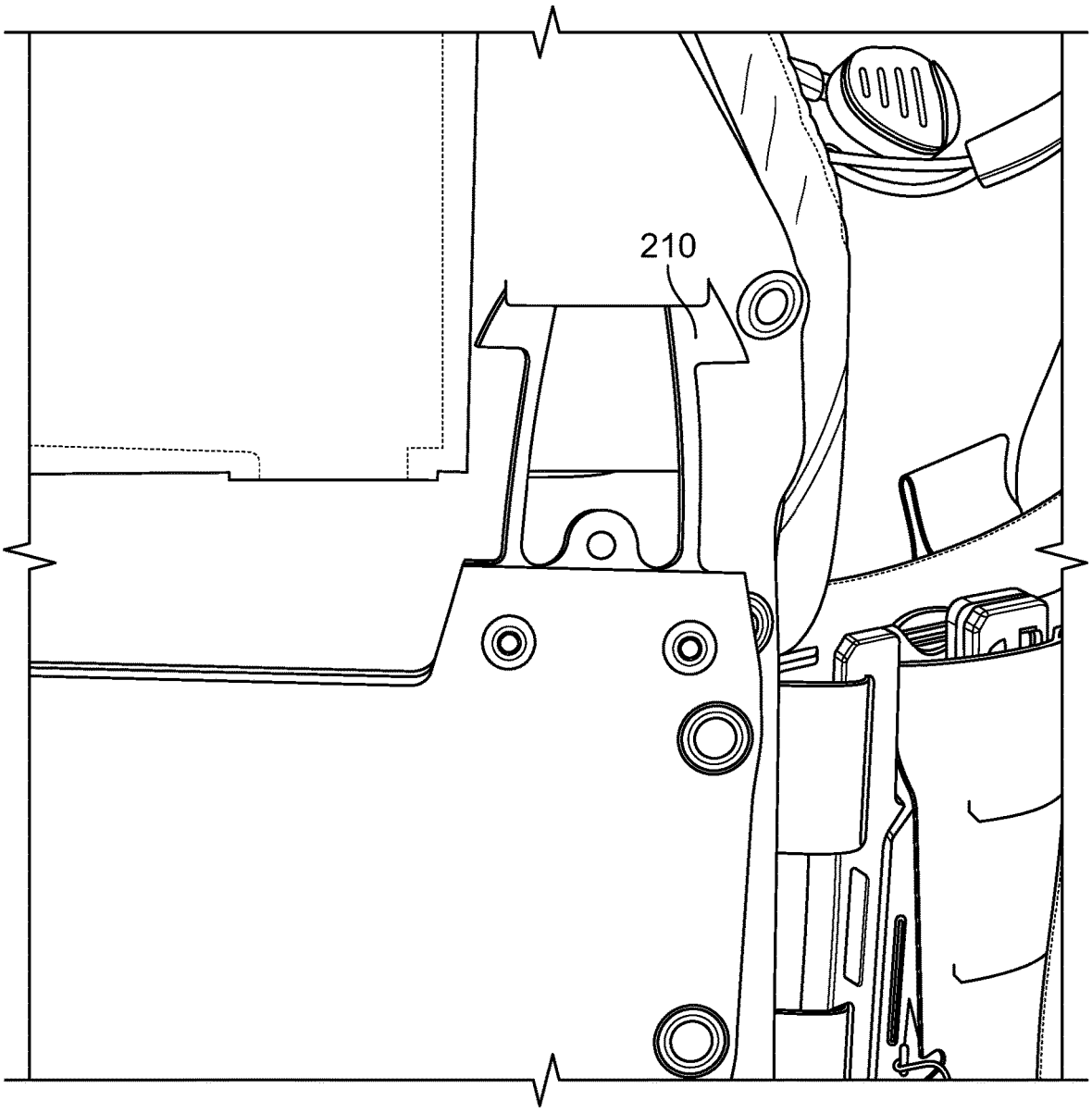
FIG. 38 shows the insertion of attachment members of the front accessory panel into corresponding openings on the armor carrier.
Figure 39:
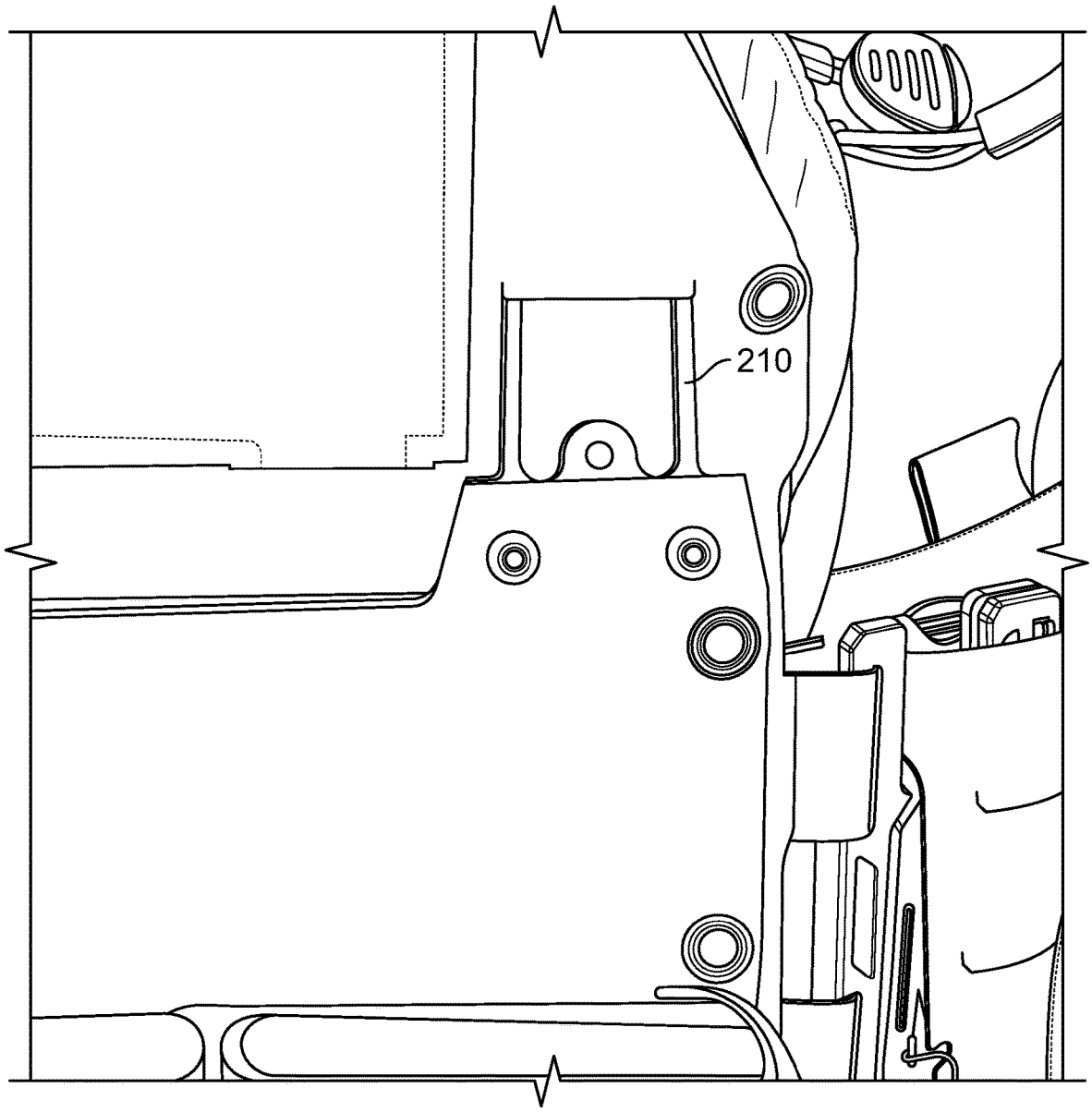
FIG. 39 shows the insertion of attachment members of the front accessory panel into corresponding openings on the armor carrier.

In some embodiments, the top edge of the front accessory panel 208 includes one or more rigid attachment members or fasteners 210 (buckles, clasps, or prongs) that are retained in corresponding openings on the upper portion of the front panel 202 of the armor carrier 200. In some embodiments, the rigid attachment member or fastener 210 is configured to enter through an connect with an opening designed to secure accessories, such as a 1"-1.5" opening on the armor carrier 200 or an accessory, a laser cut opening, a MOLLE webbing system-compatible opening. This attachment configuration assures that the front accessory panel 208 is aligned and secured with respect to the front panel 202 for ease of attachment and use. FIGS. 37-39 depict the insertion of buckles of the front accessory panel into corresponding openings on the armor carrier.

Armor Pouches

Figure 40:
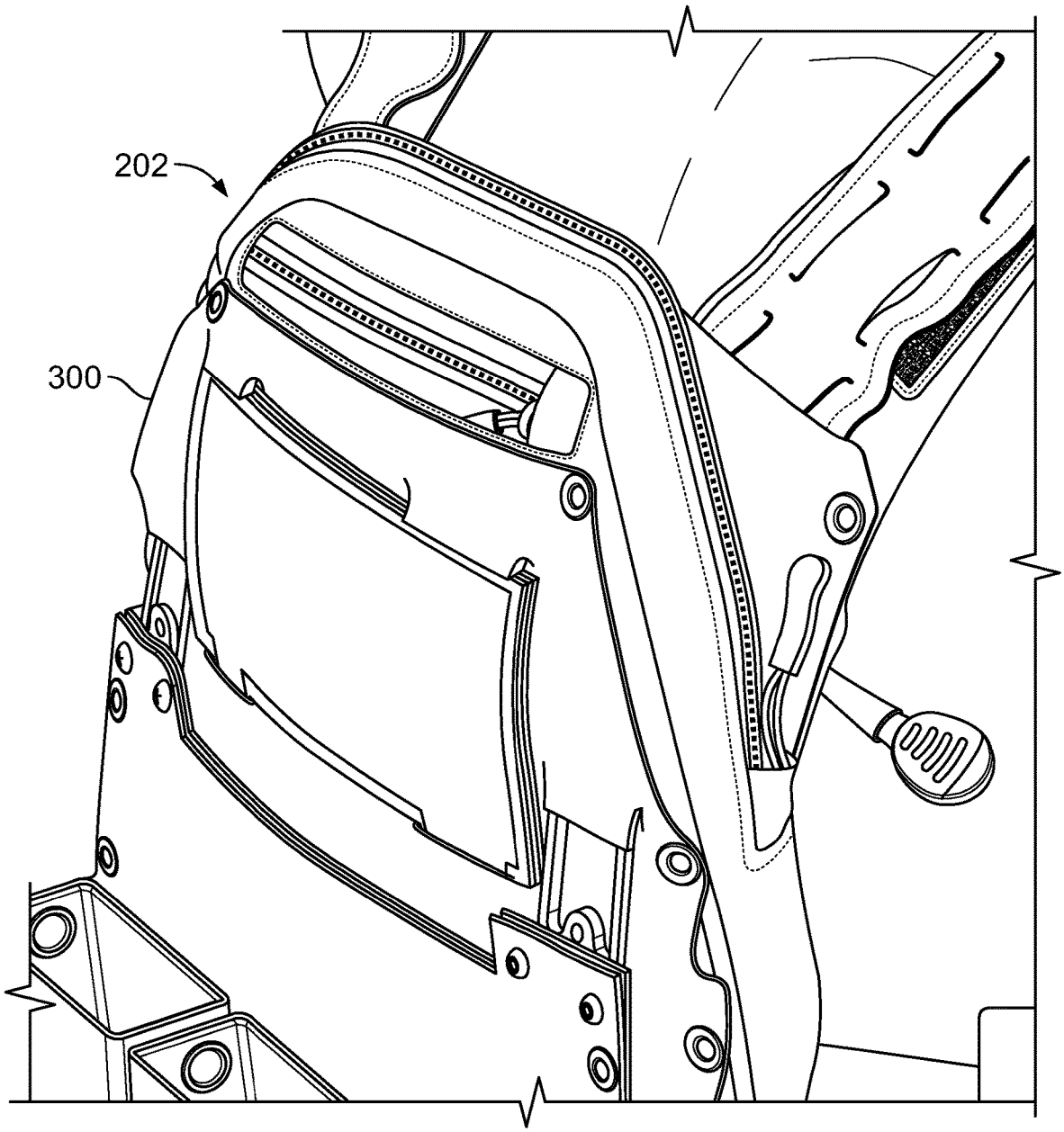
FIG. 40 the closed state of a zippered pouch of the armor carrier in which armor is inserted and retained.
Figure 41:
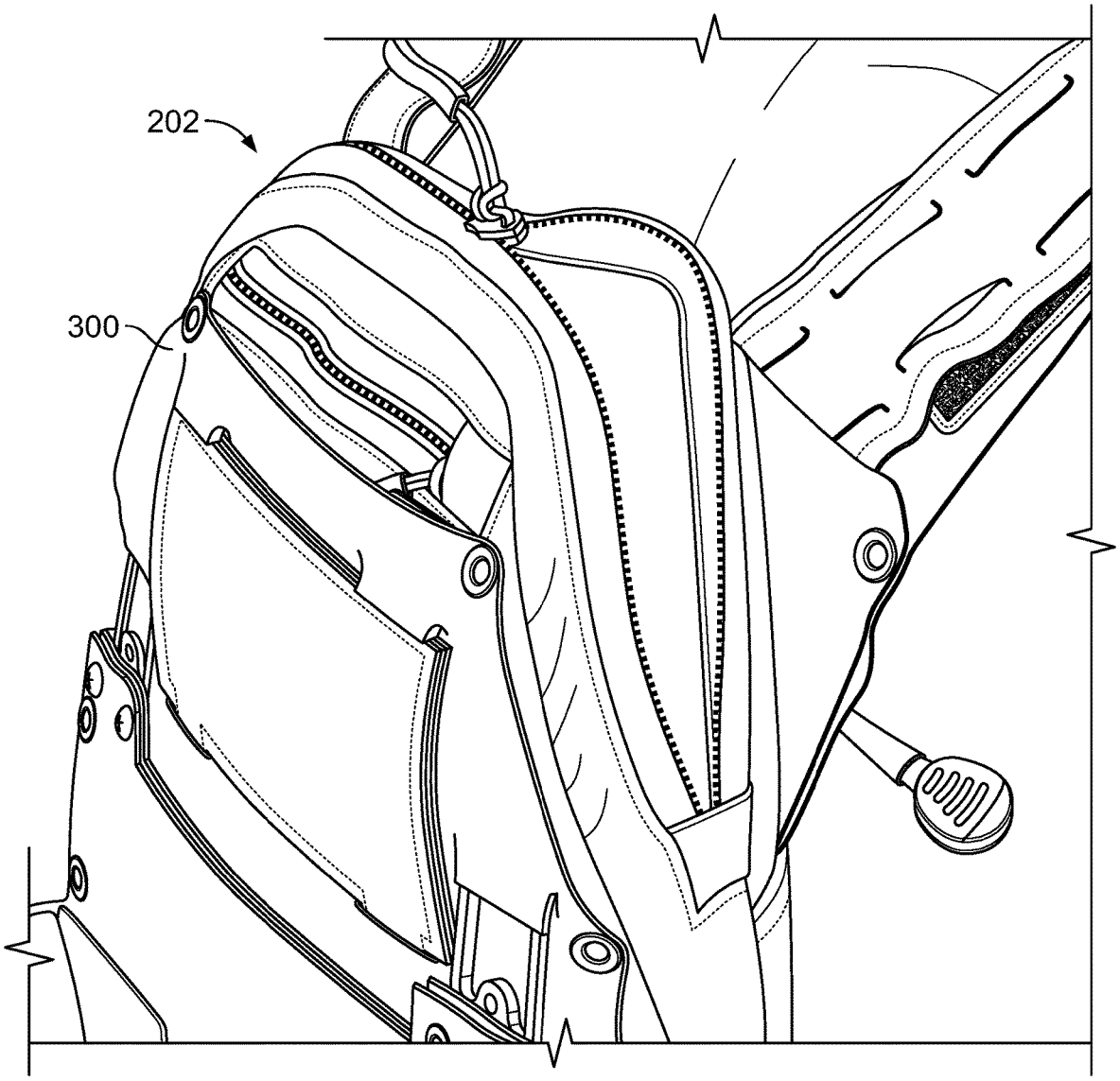
FIG. 41 shows the open state of a zippered pouch of the armor carrier in which armor is inserted and retained.

FIGS. 40-41 show the closed and opened state of a pouch 300 at the front panel 202 of the armor carrier in which armor (soft, hard, fragmentation, or the like) is inserted and retained. A corresponding pouch is located on the back panel 203 and may also receive and retain armor (soft, hard, fragmentation, or the like). In some embodiments, the pouches have a zippered opening to provide a much easier means for adding and removing body armor to the carrier in comparison to traditional sleeves and openings which are typically accessed at an interior aspect of a carrier. In some embodiments, the zippered pouches are configured to extend outward to accommodate curved body armor plates without bunching or discomfort for the wearer. The pouches may be configured to be removable from the respective front and back panels of the armor carrier by hook and loop fasteners, wedges or edges received in corresponding openings on the panels, or other releasable fasteners.

Modular Accessory System

Figure 42:
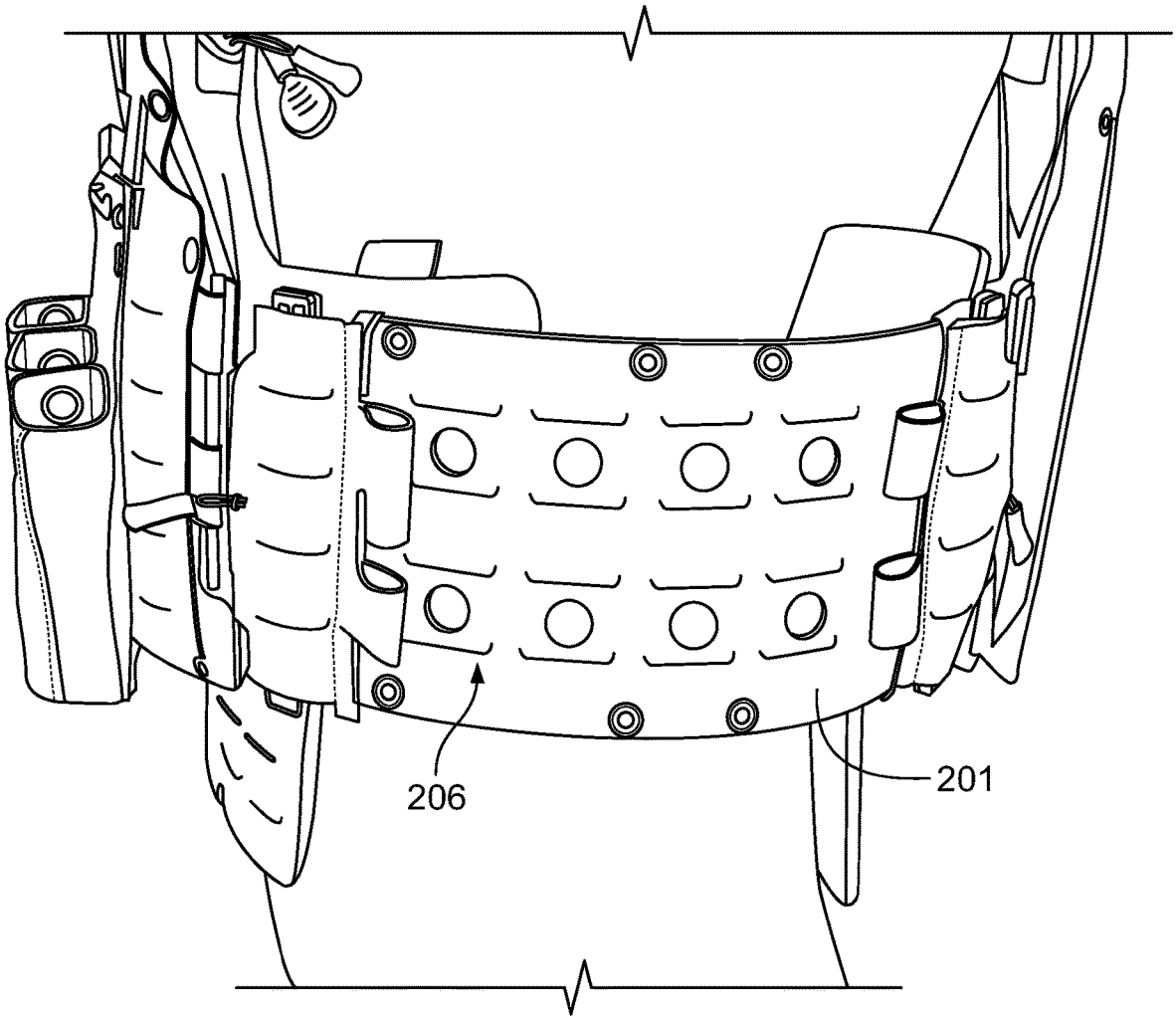
FIG. 42 shows a modular accessory system on the sides of the armor carrier.
Figure 43:
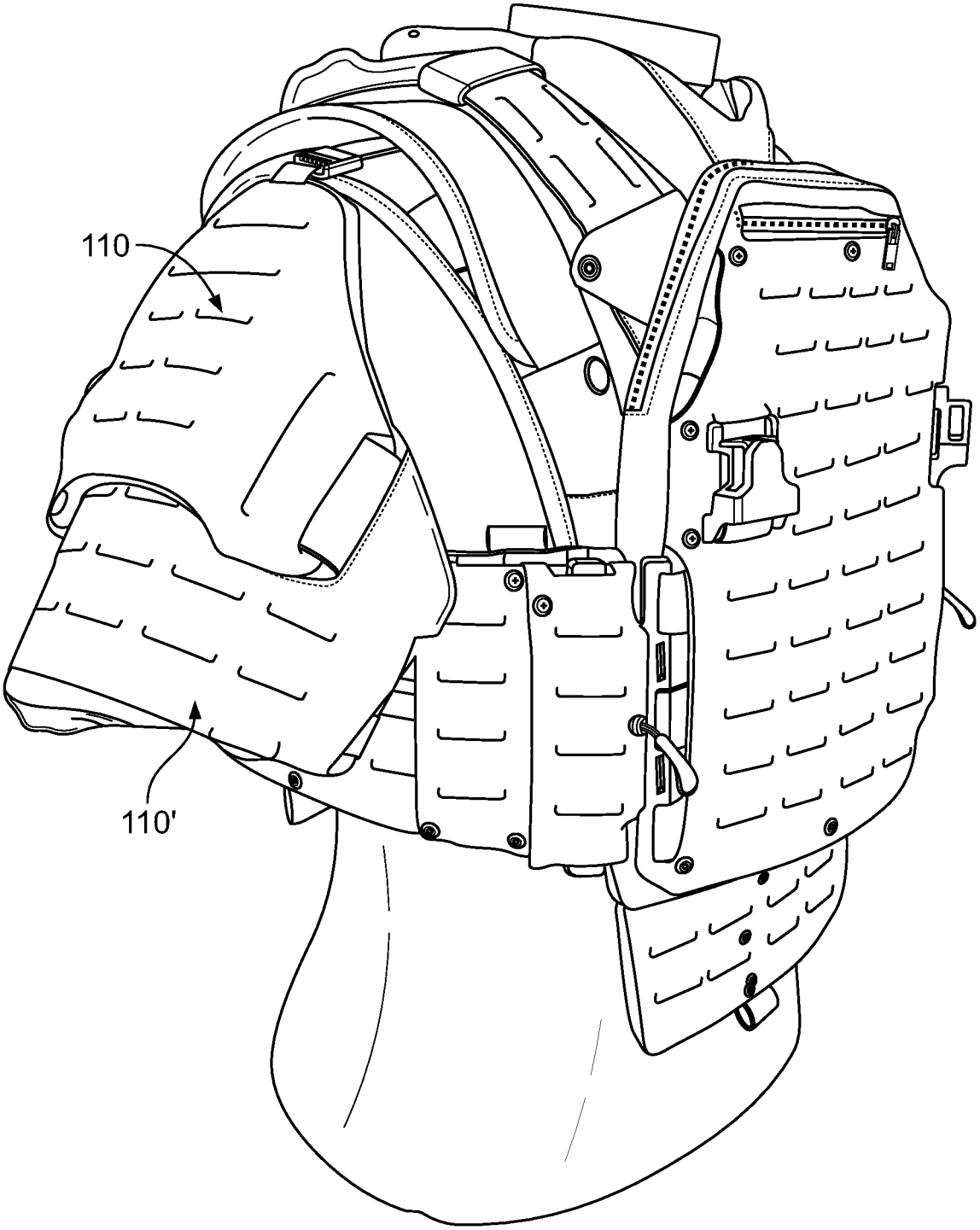
FIG. 43 shows a bicep protector.

FIG. 42 shows a modular accessory system 206 on the side straps 201 of the armor carrier. One or more spaced-apart rows of apertures are provided, which can be used as mounting points for accessories such as sheaths, holsters, and the like, which accessories have corresponding snaps that fit inside the apertures. In some embodiments, the modular accessory system 206 facilitates the attachment of sliding or moveable accessories. The accessories may be attached by any male-female fitting that passes through the apertures.

Materials

It is appreciated and understood that the body armor system described herein can be of a multi-material construction. In some embodiments, the fabrics that face inward toward the wearer or otherwise come in contact with the body of the wearer, such as the collar, are composed of a no-snag pack cloth or nylon material. This avoids snagging on rough skin or facial hair. In some embodiments, the body armor system utilizes rivets or grommets as a supplement or replacement for bar tacks or other sewing connections to minimize the amount of visible traditional stitching which can snag and otherwise wear out over time. Rivets and grommets also improve manufacturing tolerances and ease of manufacturing in general, as less manual sewing is required and the unit can be more easily built from a template.

As referred to herein, soft body armor, or soft ballistics, refer to a relatively soft and flexible but strong material, such as Kevlar or polyethylene, inserted into or otherwise forming a garment (or portion thereof) worn by a user for protective purposes. Generally, soft armor is distinguished from hard armor, as referred to herein, the latter typically presented in the form of thick, rigid plates made of firm, durable materials such as ceramic, ceramic composites, polyethylene, fibers, Kevlar, steel, and the like. Hard armor plates do not readily deform or otherwise conform to the body of the wearer. In many cases, protective garments utilize a combination of soft and hard armor in order to strike a balance between wearability, comfort, and mobility on the one hand, and maximum protection on the other hand.

It is to be noticed that the term "opening" as used herein and in the claims shall be deemed limited as it may refer to any number of slots, slits, apertures, channels, covered areas, or the like. It is to be noticed that the term "comprising," used in the claims, should not be interpreted as being limitative to the means listed thereafter. Thus, the scope of the expression "a device comprising means A and B" should not be limited to devices consisting only of components A and B. It means that with respect to the present invention, the only relevant components of the device are A and B. Put differently, the terms "including", "comprising" and variations thereof mean "including but not limited to", unless expressly specified otherwise.

Similarly, it is to be noticed that the term "coupled", also used in the claims, should not be interpreted as being limitative to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

The enumerated listing of items does not imply that any or all of the items are mutually exclusive, unless expressly specified otherwise. The terms "a", "an" and "the" mean "one or more", unless expressly specified otherwise.

Elements of the invention that are in communication with each other need not be in continuous communication with each other, unless expressly specified otherwise. In addition, elements of the invention that are in communication with each other may communicate directly or indirectly through one or more other elements or other intermediaries.

One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that any alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. A protective mantle and accessory hub, comprising:

a primary yoke configured to drape at least partially over the thorax of the wearer;

a central panel suspended between respective front sides of the primary yoke, wherein an elastic lateral expansion feature is disposed between the central panel and each of the respective front sides of the primary yoke; and a sliding attachment point disposed on the central panel of the primary yoke, which sliding attachment point attaches to an interior aspect of an armor carrier worn over the primary yoke, wherein the primary yoke retains one or more accessories.

2. The protective mantle and accessory hub of claim 1, wherein the accessories include a throat guard, a deltoid guard, and a collar.

3. The protective mantle and accessory hub of claim 2, wherein the deltoid guard is removably attached to a shoulder area of the primary yoke.

4. The protective mantle and accessory hub of claim 3, wherein the deltoid guard is removably attached to the shoulder area of the primary yoke by an expandable element.

5. The protective mantle and accessory hub of claim 4, including a bicep guard attached to the deltoid guard such that the bicep guard can articulate with respect to the deltoid guard.

6. The protective mantle and accessory hub of claim 2, wherein the throat guard is removably attached to the collar of the primary yoke.

7. The protective mantle and accessory hub of claim 2, wherein the throat guard is removably received in one or more openings of the primary yoke.

8. The protective mantle and accessory hub of claim 7, wherein at least one of the one or more openings is located on the collar of the primary yoke.

9. The protective mantle and accessory hub of claim 1, wherein a shoulder suspension member is received by the primary yoke, wherein at least a portion of the shoulder suspension member is raised above the primary yoke and wherein the shoulder suspension member is configured to distribute the weight of an armor carrier disposed over the primary yoke.

10. The protective mantle and accessory hub of claim 1, comprising a ballistic material.

11. The protective mantle and accessory hub of claim 10, wherein the ballistic material comprises soft armor.

12. A protective mantle and accessory hub, comprising:

a primary yoke configured to drape at least partially over the thorax of the wearer;

wherein a front of the primary yoke includes a central panel suspended between respective front sides of the primary yoke;

wherein a lateral expansion feature is disposed between the central panel and each of the respective front sides of the primary yoke; and wherein the primary yoke retains one or more accessories.

13. The protective mantle and accessory hub of claim 12, wherein the accessories include a throat guard, a deltoid guard, and a collar.

14. The protective mantle and accessory hub of claim 13, wherein the deltoid guard is removably attached to a shoulder area of the primary yoke.

15. The protective mantle and accessory hub of claim 14, wherein the deltoid guard is removably attached to the shoulder area of the primary yoke by an expandable element.

16. The protective mantle and accessory hub of claim 15, including a bicep guard attached to the deltoid guard such that the bicep guard can articulate with respect to the deltoid guard.

17. The protective mantle and accessory hub of claim 13, wherein the throat guard is removably attached to the collar of the primary yoke.

18. The protective mantle and accessory hub of claim 13, wherein the throat guard is removably received in one or more openings of the primary yoke.

19. The protective mantle and accessory hub of claim 18, wherein at least one of the one or more openings is located on the collar of the primary yoke.

20. The protective mantle and accessory hub of claim 12, wherein a shoulder suspension member is received by the primary yoke, wherein at least a portion of the shoulder suspension member is raised above the primary yoke and wherein the shoulder suspension member is configured to distribute the weight of an armor carrier disposed over the primary yoke.

21. The protective mantle and accessory hub of claim 12, comprising a ballistic material.

22. The protective mantle and accessory hub of claim 21, wherein the ballistic material comprises soft armor.

* * * * *